US007738803B2

(12) United States Patent
Fujita et al.

(10) Patent No.: US 7,738,803 B2
(45) Date of Patent: Jun. 15, 2010

(54) IMAGE FORMING METHOD AND APPARATUS FOR EFFECTIVELY CHARGING AN IMAGE CARRIER

(75) Inventors: Tetsumaru Fujita, Hyogo-ken (JP); Yuji Nagatomo, Osaka (JP); Yoshio Sakagawa, Hyogo-ken (JP)

(73) Assignee: Ricoh Company Limited, Tokyo (JP)

( * ) Notice: Subject to any disclaimer, the term of this patent is extended or adjusted under 35 U.S.C. 154(b) by 178 days.

(21) Appl. No.: 11/849,686

(22) Filed: Sep. 4, 2007

(65) Prior Publication Data

US 2008/0056745 A1 Mar. 6, 2008

(30) Foreign Application Priority Data

Sep. 4, 2006 (JP) ..... 2006-238553
Jul. 10, 2007 (JP) ..... 2007-180554

(51) Int. Cl.
*G03G 15/02* (2006.01)

(52) U.S. Cl. ..... 399/50; 399/175

(58) Field of Classification Search ..... 399/50, 399/175, 176

See application file for complete search history.

(56) References Cited

U.S. PATENT DOCUMENTS 5,778,286 A * 7/1998 Kido et al. ..... 399/159
2007/0065179 A1 3/2007 Fujita
2007/0172259 A1 7/2007 Fujita

FOREIGN PATENT DOCUMENTS

JP 59033467 A * 2/1984
JP 2003-122098 4/2003

OTHER PUBLICATIONS

Machine Translation of JP 2003-122098 A.*
Translation of JP 59-033467 A.*
U.S. Appl. No. 12/141,464, filed Jun. 18, 2008, Sakagawa, et al.
U.S. Appl. No. 12/178,108, filed Jul. 23, 2008, Fujita, et al.
U.S. Appl. No. 12/187,021, filed Aug. 6, 2008, Shono, et al.
U.S. Appl. No. 12/204,083, filed Sep. 4, 2008, Fujita, et al.

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

An image forming apparatus, performing a corresponding method of image forming, includes an image carrier, a writing unit, a developing unit, a charging member configured to rotate continuously with the image carrier at a portion contacting the image carrier and uniformly charge a surface of the image carrier while contacting a surface thereof with the surface of the image carrier, a charge bias applying unit configured to apply a charge bias to the charging member, and a controller configured to control of driving of the image carrier and the charging member and reduce at a charge nip at a given timing a linear velocity ratio of a travel speed of the surface of the charging member to a travel speed of the surface of the image carrier.

20 Claims, 8 Drawing Sheets

IMAGE FORMING METHOD AND APPARATUS FOR EFFECTIVELY CHARGING AN IMAGE CARRIER

CROSS-REFERENCE TO RELATED APPLICATIONS

The present patent application claims priority under 35 U.S.C. §119 from Japanese Patent Application No. 2006-238553 filed on Sep. 4, 2006 in the Japan Patent Office, and No. 2007-180554 filed on Jul. 10, 2007 in the Japan Patent Office, the entire contents and disclosures of which are hereby incorporated by reference herein in their entirety.

BACKGROUND OF THE INVENTION

1. Field of the Invention

Exemplary embodiments of the present invention generally relate to an image forming method and apparatus for effectively charging an image carrier, and more particularly to an image forming apparatus that can uniformly charge a surface of an image carrier while contacting a surface of a charging member to which a charge bias is applied, and an image forming method used in the above-described image forming apparatus.

2. Discussion of the Related Art

When producing copies of an original document, related-art electrophotographic image forming apparatuses cause a charging unit to uniformly charge a surface of an image carrier, an optical writing unit to irradiate the surface of the image carrier to form an electrostatic latent image on the surface of the image carrier, and a developing unit to develop the electrostatic latent image into a visible toner image. The visible toner image is transferred onto a recording medium such as a transfer sheet directly from the image carrier or onto an intermediate transfer member before being transferred onto a recording medium.

In a known charging unit, a charging member, such as a charge roller and a charging brush roller, contacts the image carrier to form a charge nip and apply a charge bias to the charge nip, thereby uniformly charging the surface of the image carrier.

In the related-art image forming apparatuses including such charging unit, residual toner may remain on the surface of the image carrier after the transfer operation of the toner image. As the image carrier rotates, the residual toner remaining on the surface of the image carrier may be conveyed to the charge nip and adhere to the charging member. As the amount of residual toner adhering to the charging member continues to increase, defective charging occurs in a local region or local regions on the surface of the image carrier, resulting in deterioration of image quality.

To avoid the above-described drawback, some related-art image forming apparatuses have a configuration in which a surface of a charge roller serving as a charging member travels in a direction opposite to a surface of an image carrier at a charge nip that is a contact portion of the charge roller and the image carrier, so that the surface of the image carrier can be uniformly charged.

The related-art image forming apparatuses having the above-described configuration cause the charge roller to rotate after a print job and/or before an image forming operation at a speed greater than a speed thereof generated during the image forming operation. By speeding up the rotation of the charge roller as described above, the residual toner remaining on the charge roller can effectively be discharged to the image carrier, that is, the amount of residual toner discharged can be increased.

A detailed description is now given of the enhancement of toner discharge efficiency or efficiency of discharging residual toner remaining on the charge roller in a related-art image forming apparatus having the above-described configuration.

FIG. 1 shows a schematic configuration of an image forming part of a related-art image forming apparatus 200.

The related-art image forming apparatus 200 includes a charge roller 201, a photoconductor 202, and a developing unit 205. The charge roller 201 and the photoconductor 202 form a charge nip therebetween.

As indicated by arrows shown in FIG. 1, the surface of the charge roller 201 travels in a direction opposite to a direction of travel of the surface of the photoconductor 202 at the charge nip.

A point P11 located at the right end of the charge nip in FIG. 1 corresponds to an entrance or start point of the charge nip of the charge roller 201. Toner particles T adhering to the surface of the charge roller 201 enter the charge nip via the point P11 in FIG. 1. At this time, the photoconductor 202 traveling in the opposite direction to the charge roller 201 at the charge nip exerts a force of removing or scraping the toner particles T. Therefore, the toner particles T are discharged from the charge roller 202 at the point P11. The discharged toner T is then conveyed along the surface of the photoconductor 202 and to the developing unit 205, without entering the charge nip.

In the image forming apparatus 200 having the above-described configuration, when the rotation speed of the charge roller 201 increases, a difference between the linear velocity of the charge roller 201 and the linear velocity of the photoconductor 202 may increase, thereby increasing a removing force of the toner particles T at the point P11.

According to the above-described operations, it is believed that the efficiency of discharge of the toner particles T from the charge roller 201 can be enhanced.

However, when the above-described configuration or a first configuration in which the surface of the charge roller 201 and the surface of the photoconductor 202 travel in the opposite directions at the charge nip is compared with a second configuration in which the surface of the charge roller 201 and the surface of the photoconductor 202 travel in the same direction at the charge nip, the image forming apparatus 200 with the first configuration may require a greater amount of a driving torque generated by each driving source for the charge roller 201 and the photoconductor 202. Therefore, the driving source for the first configuration may need to be larger than the driving source for the second configuration, and such a large-sized driving source can increase costs.

Consequently, to reduce such costs, it would be preferable to use the second configuration and have the surface of the charge roller 201 and the surface of the photoconductor 202 to travel in the same direction at the charge nip. However, the inventors of the present invention have conducted tests and found that the second configuration cannot efficiently increase the toner discharge efficiency of the charge roller 201 even when the rotation speed of the charge roller 201 is increased. That is, it is believed that, when the surface of the charge roller 201 travels in the same direction as the surface of the photoconductor 202, the surface of the photoconductor 202 cannot apply the toner removing force to the toner T remaining on the surface of the charge roller 201.

SUMMARY OF THE INVENTION

Exemplary aspects of the present invention have been made in view of the above-described circumstances, and provides an image forming apparatus that can reduce the sizes of driving sources of a charging member and an image carrier and the costs, and efficiently discharge toner from the charging member.

Other exemplary aspects of the present invention provide an image forming method that can be performed in the above-described image forming apparatus.

In one exemplary embodiment, an image forming apparatus includes an image carrier configured to carry an image on a surface thereof and rotate continuously, a writing unit configured to write a latent image on the charged surface of the image carrier, a developing unit configured to develop the latent image formed on the surface of the image carrier into a visible toner image, a charging member configured to rotate continuously with the image carrier at a portion contacting the image carrier and uniformly charge the surface of the image carrier while contacting a surface thereof with the surface of the image carrier, a charge bias applying unit configured to apply a charge bias to the charging member, and a controller configured to control driving of the image carrier and the charging member and reduce at a charge nip at a given timing a linear velocity ratio of a travel speed of the surface of the charging member to a travel speed of the surface of the image carrier.

Further, in one exemplary embodiment, an image forming method includes rotating an image carrier to move a surface thereof continuously, writing a latent image on the surface of the image carrier, the surface of the image carrier being charged, developing the latent image formed on the surface of the image carrier and the surface of the image carrier is charged into a visible toner image, rotating a charging member to move with the image carrier at a portion contacting the charging member with the image carrier, uniformly charging the surface of the image carrier while contacting a surface thereof with the surface of the image carrier, applying a charge bias to the charging member, and reducing a linear velocity ratio of a travel speed of the surface of the charging member to a travel speed of the surface of the image carrier at a charge nip at a given timing.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
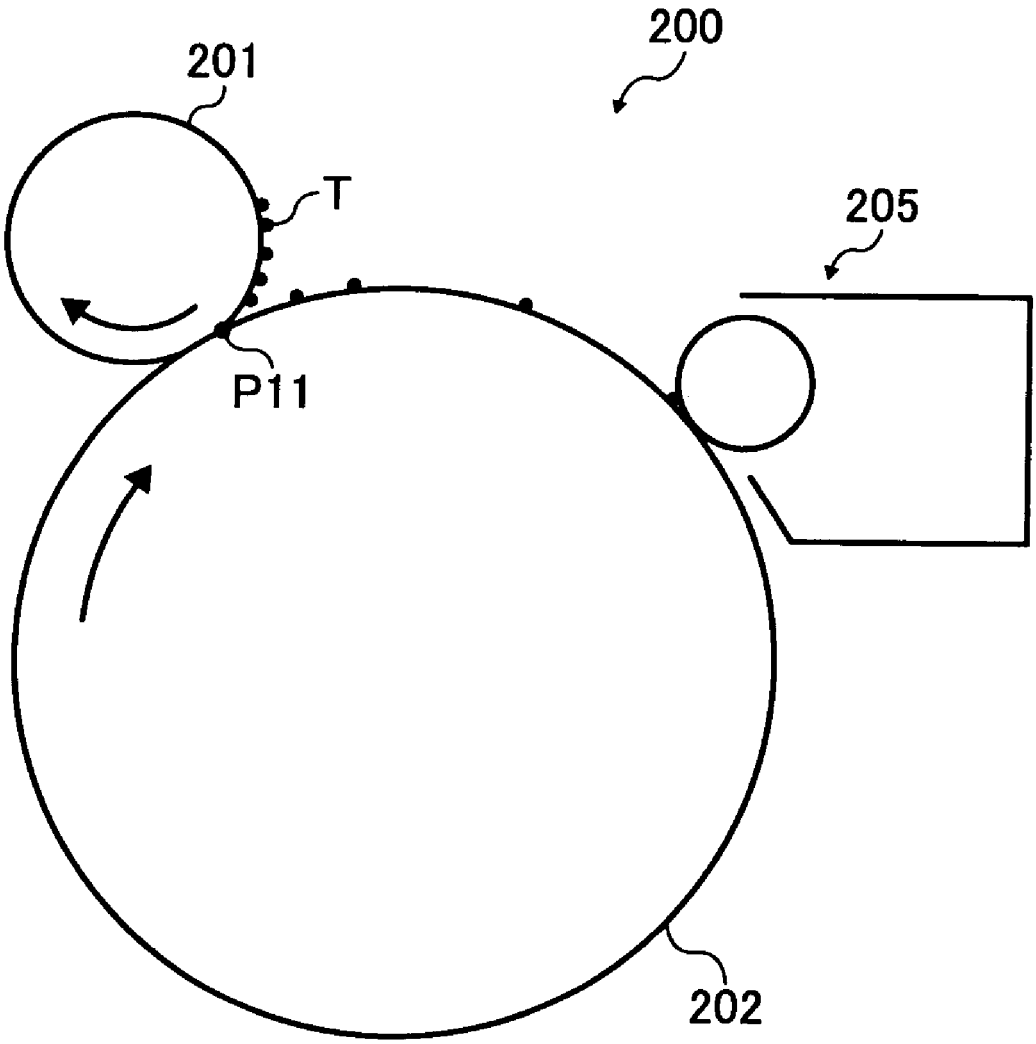
FIG. 1 BACKGROUND ART
FIG. 1 is a schematic configuration of a background image forming apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
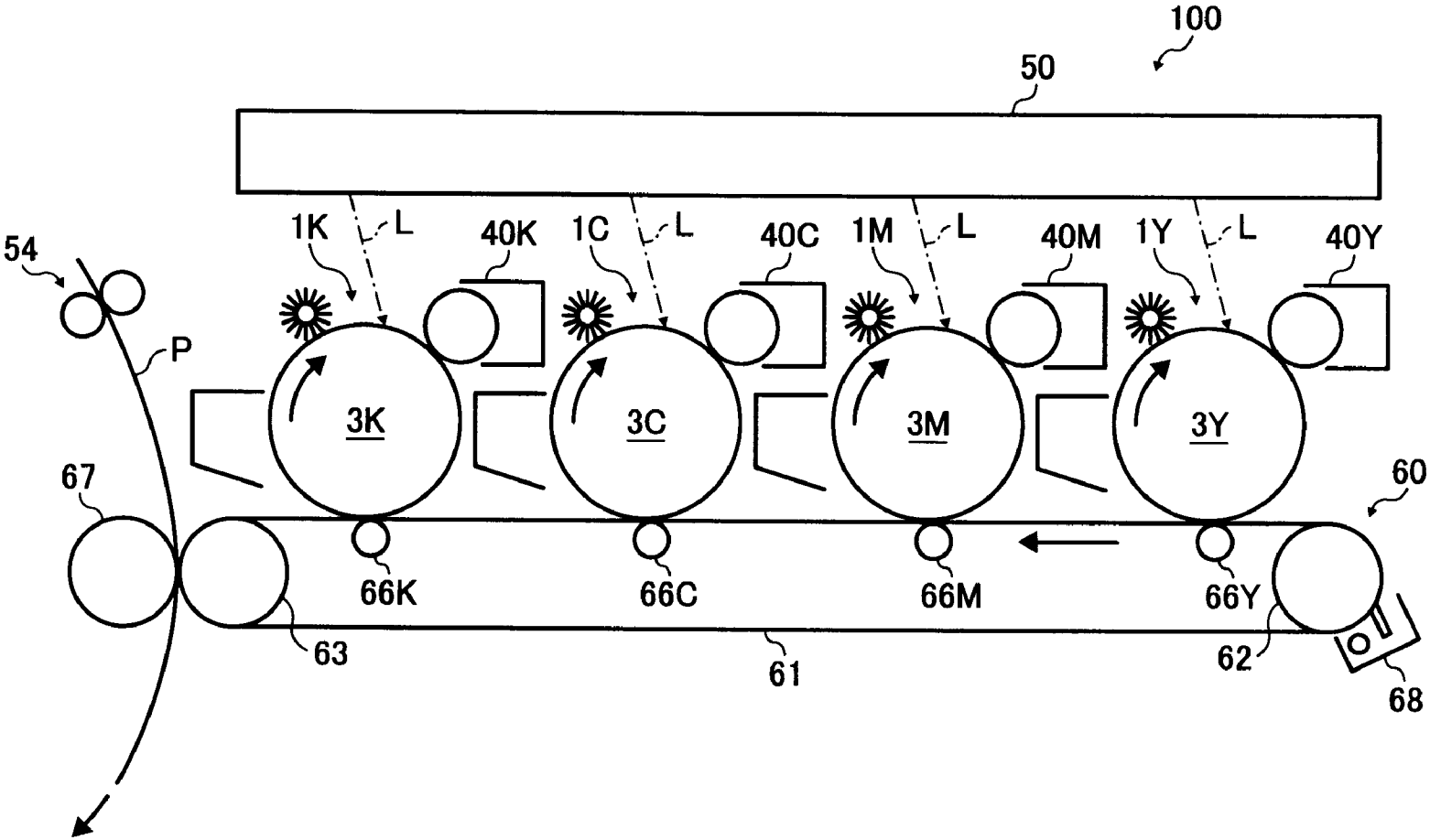
FIG. 2 is a schematic configuration of an image forming apparatus according to an exemplary embodiment of the present invention.
Figure 3:
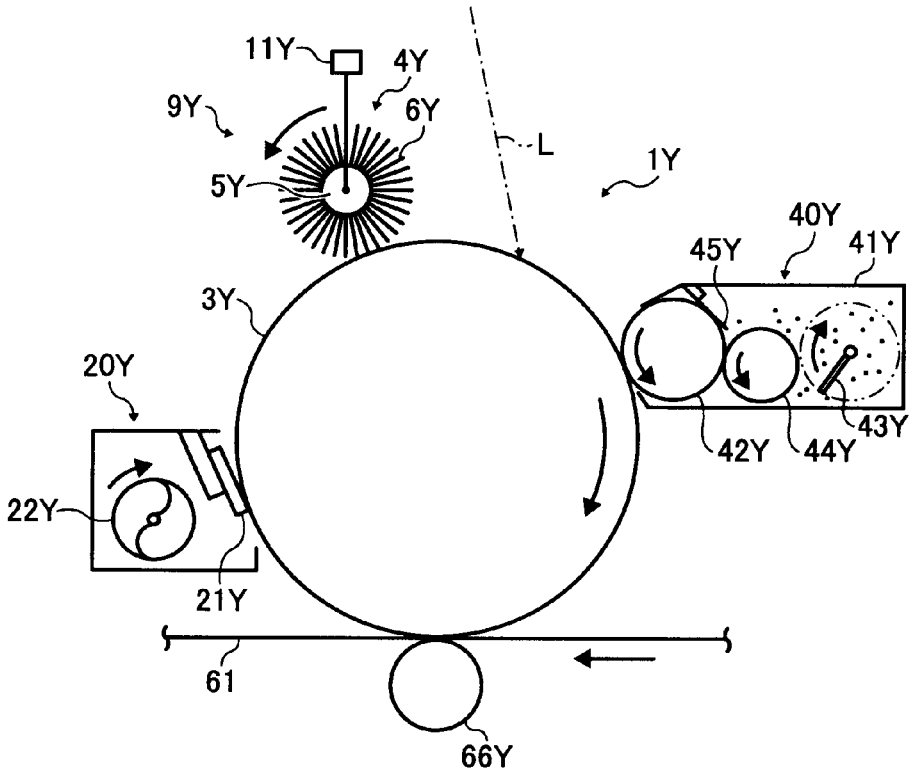
FIG. 3 is an enlarged view of a process unit of the image forming apparatus of FIG. 2.

Referring to FIGS. 2 and 3, a description is given of an electrophotographic color laser printer 100 according to an exemplary embodiment of the present invention.

FIG. 2 shows a schematic configuration of the electrophotographic color laser printer 100.

The electrophotographic color laser printer 100 serves as an image forming apparatus according to an exemplary embodiment of the present invention.

Hereinafter, the electrophotographic color laser printer 100 is referred to as a "printer 100."

In FIG. 2, the printer 100 includes four process units 1Y, 1M, 1C, and 1K, an optical writing unit 50, a pair of registration rollers 54, and a transfer unit 60.

The four process units 1Y, 1M, 1C, and 1K are cartridge type units and can integrally include image forming components therein for forming corresponding color toner images. The process units 1Y, 1M, 1C, and 1K include respective colors of toners, for example, yellow (Y), magenta (M), cyan (C), and black (K).

The suffixes provided to respective components are for indicating the color of toner used therefor.

The optical writing unit 50 includes light sources including four laser diodes for yellow, magenta, cyan, and black toner images, a polygon mirror, a polygon motor for rotating the polygon mirror, f-theta lens, other lenses, reflection mirrors, and so forth.

Respective laser light beams L that are emitted by the above-described laser diodes of the optical writing unit 50 reflect on one of the surfaces of the polygon mirror. The reflected laser light beams L are deflected according to rotations of the polygon mirror and reach a corresponding one of four photoconductor drums 3Y, 3M, 3C, and 3K, which will be described below. The laser light beams L emitted by the laser diodes of the optical writing unit 50 may expose respective surfaces of the four photoconductor drums 3Y, 3M, 3C, and 3K.

The process units 1Y, 1M, 1C, and 1K include drum-shaped photoconductors 3Y, 3M, 3C, and 3K that serve as image carrier, developing units 40Y, 40M, 40C, and 40K corresponding to the respective photoconductors 3Y, 3M, 3C, and 3K, and so forth.

The photoconductors 3Y, 3M, 3C, and 3K include a raw tube e.g., an aluminum tube, covered by an organic photoconductive (OPC) layer. The photoconductors 3Y, 3M, 3C, and 3K are rotated by respective photoconductor drive units, not shown, at a predetermined linear velocity in a clockwise direction in FIG. 2. Then, based on image data that is sent from a personal computer, not shown, the optical writing unit 50 emits the modulated laser light beams L to irradiate the photoconductors 3Y, 3M, 3C, and 3K for forming respective electrostatic latent images.

FIG. 3 shows a schematic configuration of the process unit 1Y for forming yellow toner images, together with the transfer unit 60 and an intermediate transfer belt 61 included in the transfer unit 60.

Since the four process units 1Y, 1M, 1C, and 1K have the structure and function identical to each other, the process unit 1Y for yellow toner images in FIG. 3 is a representative process unit, and the other process units 1M, 1C, and 1K can perform the same functions as the process unit 1Y as described below.

In FIG. 3, the process unit 1Y for yellow toner images includes the photoconductor 3Y, a charging brush roller 4Y, a discharge lamp, not shown, the developing unit 40Y, and other image forming components. The above-described image forming components are integrally mounted to a common unit casing or housing to be detachable with respect to a main body of the printer 100.

The photoconductor 3Y serves as an image carrier for carrying an electrostatic latent image for yellow toner image, and is a target member to be charged by a charging unit 9Y that includes the charging brush roller 4Y for charging the surface of the photoconductor 3Y.

The photoconductor 3Y includes a drum-shaped or cylinder-shaped member having a diameter of 24 mm, for example. Specifically, the photoconductor 3Y has a conductive base member including an aluminum tube and a photoconductive layer including negative electric organic photoconductor (OPC) covered around the conductive base member. The photoconductor 3Y is rotated by a photoconductor drive unit, not shown, at a given linear velocity in a clockwise direction in FIG. 3, as indicated by an arrow in FIG. 3. Therefore, the surface of the photoconductor 3Y passes a primary transfer nip that is a contact portion with the intermediate transfer belt 61, a cleaning portion that is a contact portion with a cleaning blade 21Y, a charge nip that is a contact portion with the charging brush roller 4Y, an optical writing portion, and a developing portion in this order.

The charging brush roller 4Y of FIG. 3 includes a rotary shaft member 5Y, and multiple conductive fibrous members 6Y.

The rotary shaft member 5Y and the multiple conductive fibrous members 6Y form the charging brush roller 4Y that serves as a charging member.

The rotary shaft member 5Y is formed by a metallic material that can be rotatably born by a bearing, not shown.

The multiple conductive fibrous members 6Y are disposed perpendicular to a circumferential surface of the rotary shaft member 5Y.

While a charge member drive unit, not shown, rotates the charging brush roller 4Y about an axis of the rotary shaft member 5Y in a counterclockwise direction in FIG. 3, respective tips or leading edges of the multiple conductive fibrous members 6Y slidably contact the surface of the photoconductor 3Y.

The rotary shaft member 5Y is connected to a charge bias applying unit 11Y including a power source, not shown, and wires, not shown, so that a charge bias that includes an AC bias voltage superimposed on a DC bias voltage can be applied to the charging brush roller 4Y.

In the printer 100, it is controlled that the surface of the charging brush roller 4Y rotates with the surface of the photoconductor 3Y at the charge nip. That is, the surface of the charging brush roller 4Y travels in the same direction, which is a forward direction, as the surface of the photoconductor 3Y. Accordingly, when compared with a configuration in which the surface of the charging brush roller 4Y travels in an opposite direction, which is a counter direction, to the surface of the photoconductor 3Y, the above-described configuration in which the surface of the charging brush roller 4Y travels in the same direction as the surface of the photoconductor 3Y can achieve lower costs by using smaller motors for the charging brush roller 4Y and for the photoconductor 3Y.

In the printer 100, the charging brush roller 4Y, the charging member drive unit, not shown, for driving the charging brush roller 4Y, and the charge bias applying unit 11Y form a charging system of the printer 100 so that the surface of the photoconductor 3Y can be uniformly charged. The printer 100 is controlled to cause electrical discharge between the multiple conductive fibrous members 6Y of the charging brush roller 4Y and the photoconductor 3Y, and uniformly charge the surface of the photoconductor 3Y to a negative polarity.

On the uniformly charged surface of the photoconductor 3Y for yellow toner image, the above-described optical writing unit 50 optically scans and forms an electrostatic latent image for a yellow toner image on the surface of the photoconductor 3Y. The electrostatic latent image for yellow color is developed into a yellow toner image by the developing unit 40Y.

The developing unit 40Y for developing yellow color images includes a casing 41Y and a developing roller 42Y.

The developing roller 42Y includes a shaft. Both ends of the shaft protrude from respective sides of the developing roller 42Y and are rotatably born by respective bearings, not shown.

The casing 41Y accommodates yellow toner. An agitator 43Y that is provided in the casing 41Y rotates to convey the yellow toner from the right side to the left side of the drawing.

At the left side of the agitator 43Y in FIG. 3, a toner supplying roller 44Y is disposed. The toner supplying roller 44Y is rotated by a drive unit, not shown, in a counterclockwise direction in FIG. 3. The toner supplying roller 44Y includes a roller part formed by an elastic material such as sponge and preferably collects or catches yellow toner conveyed from the agitator 43Y. The collected yellow toner is supplied to the developing roller 42Y at a contact portion of the toner supplying roller 44Y and the developing roller 42Y. The yellow toner is carried or held on a surface of the developing roller 42Y serving as a developer carrier, and passes a contact portion of the developing roller and a regulating blade 45Y. Along with rotations of the developing roller 42Y in a counterclockwise direction, the yellow toner passes the above-described contact portion. At this time, the thickness or height of a toner layer on the developing roller 42Y is regulated and/or frictional charge is performed. The yellow toner is, then, conveyed to an image forming region at which the developing roller 42Y faces the photoconductor 3Y.

In the image formation region, a development potential is provided between the developing roller 42Y to which a negative development bias is output from a power source, not shown, and the electrostatic latent image formed on the photoconductor 3Y. The development potential may cause an action of electrostatically transferring the negatively charged yellow toner from the developing roller 42Y to the electrostatic latent image on the photoconductor 3Y. In addition, a non-development potential is provided between the developing roller 42Y and a uniformly charged portion or background portion of the photoconductor 3Y so that the non-development potential may cause an action of electrostatically transferring the negatively charged yellow toner from the background portion to the developing roller 42Y.

By the action of the development potential, the yellow toner on the developing roller 42Y may be transferred from the developing roller 42Y to the electrostatic latent image on the photoconductor 3Y. According to this transfer, the electrostatic latent image is developed into a yellow toner image.

In an exemplary embodiment of the present invention, the developing unit 40Y accommodates a one-component developer including toner. However, a developing unit that can be used for the present invention is not limited to the developing unit 40Y for the one-component developer. Alternatively, a developing unit that accommodates a two-component developer including toner and magnetic carrier can be applied to the present invention.

With the rotations of the photoconductor 3Y, the yellow toner image developed on the image forming region and formed on the photoconductor 3Y may be transferred onto the intermediate transfer belt 61 at a primary transfer nip at which the photoconductor 3Y and the intermediate transfer belt 61 contact to each other.

After passing through the primary transfer nip, the photoconductor 3Y may still hold residual toner that has not been transferred onto the intermediate transfer belt 61.

To remove the residual toner, the process unit 1Y includes a drum cleaning unit 20Y and a cleaning blade 21Y.

The drum cleaning unit 20Y uses the cleaning blade 21Y to scrape the residual toner from the surface of the photoconductor 3Y.

The drum cleaning unit 20Y also includes a toner collecting screw 22Y. While the toner collecting screw 22Y rotates in the drum cleaning unit 20Y, the residual toner is conveyed in a direction perpendicular to a face of the drawing and discharged out of the drum cleaning unit 20Y. The residual toner discharged from the drum cleaning unit 20Y is conveyed into a discharged toner bottle, not shown.

As described above, the process unit 1Y may be operated to form a yellow toner image.

As previously described, the other process units 1M, 10, and 1K have basically the same functions and structures as the process unit 1Y, except for different toner colors. Therefore, description of the operations of the other process units 1M, 10, and 1K are omitted.

As shown in FIG. 2, the transfer unit 60 is disposed below and adjacent to the process units 1Y, 1M, 10, and 1K.

The transfer unit 60 includes the intermediate transfer belt 61, a driven roller 62, a drive roller 63, and four primary transfer bias rollers 66Y, 66M, 66C, and 66K.

The intermediate transfer belt 61 is formed of an endless-shaped belt member and rotates in a counterclockwise direction in FIG. 2. The intermediate transfer belt 61 is extended by and spanned around the driven roller 62, the drive roller 63, and the primary transfer bias rollers 66Y, 66M, 66C, and 66K.

The driven roller 62, the drive roller 63, and the primary transfer bias rollers 66Y, 66M, 66C, and 66K are held in contact with an inner surface of the intermediate transfer belt 61.

The four primary transfer bias rollers 66Y, 66M, 66C, and 66K are rollers, and each of which includes a metallic cored bar covered by an elastic material such as sponge. The four primary transfer bias rollers 66Y, 66M, 66C, and 66K are in press contact with the photoconductor drums 3Y, 3M, 3C, and 3K, respectively, while sandwiching the intermediate transfer belt 61 therebetween. At respective positions at which the photoconductor drums 3Y, 3M, 3C, and 3K and the intermediate transfer belt 61 contact at given intervals in a belt moving direction, four primary transfer nips for forming respective single color toner image of different colors may be formed.

A primary transfer bias controlled by a corresponding transfer bias power source, not shown, to flow a constant current is applied to the cored bars of the primary transfer bias rollers 66Y, 66M, 66C, and 66K. By so doing, a transfer charge can be provided via the primary transfer bias rollers 66Y, 66M, 66C, and 66K to the inner surface of the intermediate transfer belt 61 so that respective electric fields for transfer can be formed at the primary transfer nips formed between the intermediate transfer belt 61 and the photoconductor drums 3Y, 3M, 3C, and 3K.

In an exemplary embodiment of the present invention, the printer 100 includes a roller-shaped member, i.e., the primary transfer bias rollers 66Y, 66M, 66C, and 66K, as a primary transfer member. However, the shape of the primary transfer member is not limited to the above-described roller-shaped member. Alternatively, a brush-type member, blade-type member, or a transfer charger may be applied to the present invention.

The different single color toner images, which are yellow toner image, magenta toner image, cyan toner image, and black toner image, formed on the respective photoconductors 3Y, 3M, 3C, and 3K may be primarily transferred onto the intermediate transfer belt 61 at the respective primary transfer nips in an overlaying manner, so that a four color overlaid toner image (hereinafter, referred to as an "overlaid toner image" or "toner image") can be formed on the intermediate transfer belt 61.

At a position at which the drive roller 63 is held in contact with the intermediate transfer belt 61, a secondary transfer bias roller 67 is disposed in a manner contacting the opposite surface or outer surface of the intermediate transfer belt 61. That is, the driven roller 63 and the secondary transfer bias roller 67 are held in contact with each other by sandwiching the intermediate transfer belt 61, thereby forming a secondary transfer nip.

A secondary transfer bias is applied to the secondary transfer bias roller 67 by a voltage applying unit, not shown, which includes a power source and wiring, not shown. Thereby, an electric field for the secondary transfer can be formed between the secondary transfer bias roller 67 and the driven roller 63. The overlaid toner image formed on the intermediate transfer belt 61 comes to the secondary transfer nip according to the rotations of the intermediate transfer belt 61.

The printer 100 further includes a sheet feeding cassette, not shown, to accommodate recording media or multiple recording papers therein. The sheet feeding cassette feeds a recording paper P placed on top of the recording media accommodated therein to a sheet feeding path at a given timing.

The recording paper P fed from the sheet feeding cassette travels in the sheet feeding path and reaches a pair of registration rollers 54 disposed at a far end of the sheet feeding path, at which the recording paper P is stopped and sandwiched by the pair of registration rollers 54.

The pair of registration rollers 54 rotates to receive the recording paper P fed from the sheet feeding cassette and sandwich the recording paper P at a registration nip formed therebetween. Upon sandwiching the leading edge of the recording paper P, the pair of registration rollers 54 stops its rotation. Then, the pair of registration rollers 54 feeds the recording paper P toward the secondary transfer nip in synchronization with a movement of the overlaid toner image formed on the intermediate transfer belt 61.

At the secondary transfer nip, the overlaid toner image on the intermediate transfer belt 61 is secondarily transferred onto the recording paper P by action of the electric field of the secondary transfer and the nip pressure. On the recording paper P, the overlaid toner image is combined with a white color of the recording paper P, resulting in a formation of a full-color image.

The recording paper P with the full-color toner image thereon passes through the secondary transfer nip and comes to a fixing unit, not shown, so as to fix the full-color toner image onto the recording paper P.

After the overlaid toner image has transferred onto the recording paper P, residual toner remaining on the surface of the intermediate transfer belt 61 may be removed by a belt cleaning unit 68.

Next, processes and results of the tests performed by the inventors of the present invention are described.

The inventors prepared a test machine having the same configuration of the printer 100 of FIG. 2 according to an exemplary embodiment of the present invention.

The inventors conducted the tests with the above-described test machine to evaluate rates of discharging toner from a charging brush roller, i.e. the charging brush roller 4K for black toner. Hereinafter, the rate of discharging toner of a charging brush roller is also referred to as a "toner discharge rate." Specifically, to increase a toner accumulating speed or a speed of the charging brush roller 4K for accumulating black toner, the inventor detached a drum cleaning unit or the drum cleaning unit 20K from the process unit 1K for black toner image and made the test machine to employ the cleanerless method.

With the above-described structure, the whole amount of residual toner remaining on the photoconductor 3K may reach the charge nip without being removed. The residual toner may then be conveyed to the developing roller 42K of the developing unit 40K for black toner image.

Toner used in the tests was prepared by pulverizing methods and controlled to have an average diameter thereof of approximately 8.5 μm, with external additive.

A charging brush roller corresponding to the charging brush roller 4K includes multiple conductive fibrous members having a thickness of 2 denier. 200,000 of the multiple fibrous members, i.e., the fibrous members 6K, are mounted on a rotary shaft member, i.e., the rotary shaft member 5K, having a diameter of 5 mm in a standing manner, so that the charging brush roller 4K may be made as a roller having an outer diameter of 11 mm.

The above-described charging brush roller 4K is held in contact with the photoconductor 3Y to form a charge nip having a distance or nip width of 2 mm in the surface travel direction of the photoconductor 3K.

During the image forming operation, the inventors of the present invention applied a charge bias of a direct current voltage or DC voltage of −1100V to the charging brush roller 4K. Electrical charge applied to a positive polarity on the intermediate transfer belt 61 is attracted to the residual toner remaining on the photoconductor 3K at the primary transfer nip. According to the attraction of electrical charge, a substantially half amount of the residual toner in the test machine is reversely charged, that is, the substantially half amount of the residual toner in the test machine is charged to a positive polarity opposite to the regular polarity or negative polarity. The reversely charged toner comes to the charge nip, adheres to the charging brush roller 4K that has a greater potential to the minus side than the photoconductor 3K, and keep staying on the charging brush roller 4K.

The photoconductor 3K for black toner was driven to rotate at a linear velocity V1 of 100 mm/sec during the image forming operation.

With the test machine having the above-described configuration, a monochrome halftone chart was copied in a serial manner with a 5% image area ratio to 100 A4-size sheets to obtain multiple reproduced halftone images. The inventors then detached the charging brush roller 4K for black toner from the process unit 1K for black toner, measured the weight of the charging brush roller 4K, and reattached the charging brush roller 4K to the process unit 1K. Then, while driving multiple process units including the process unit 1K and the intermediate transfer belt 61, the inventors applied a toner discharge bias of a DC voltage of +200V to the charging brush roller 4K to conduct a toner discharging operation.

In the test machine, the difference of discharging start potentials between the charging brush roller 4K and the photoconductor 3K is 610V. Therefore, no discharge is conducted between the charging brush roller 4K and the photoconductor 3K, to which the toner discharge bias is applied. In addition, the reversely charged toner with a bias of positive polarity is discharged from the charging brush roller 4K to the photoconductor 3K charged with a bias having a lower positive polarity, and conveyed to a developing roller 42K of a developing unit 40K.

The inventors stopped the test machine at a given time after the test machine started to apply the toner discharge bias and detached the charging brush roller 4K from the process unit 1K. The inventors measured the weight of the charging brush roller 4K and calculated a toner discharge rate by using a formula, "toner discharge rate [%]=(M2−M0)/(M1−M0)". The "M0" in the formula represents a weight of the charging brush roller 4K before the test. The "M1" in the formula represents a weight of the charging brush roller 4K after a reproduction of 100 copies of the halftone chart. The "M2" in the formula represents a weight of the charging brush roller 4K after the toner discharging operation.

During the operation of printing 100 A4-size sheets of the halftone chart in a serial manner, the photoconductor 3K was rotated at the linear velocity V1, which is a travel speed of the surface of the photoconductor 3K, of 100 mm/sec and the charging brush roller 4K was also rotated at a linear velocity V2, which is a travel speed of the surface of the charging brush roller 4K, of 100 mm/sec. Therefore, the ratio of the linear velocity V2 of the charging brush roller 4K to the linear velocity V1 of the photoconductor 3K at the charge nip is 1.

In the above-described toner discharging operation, a linear velocity ratio V2/V1, which is the ratio of the linear velocity V2 of the charging brush roller 4K to the linear velocity V1 of the photoconductor 3K, at the charge nip was changed from the linear velocity ratio V2/V1 in the serial printing operation. The linear velocity ratio V2/V1 was caused to rapidly change in a short period. Then, after the completion of reproducing or printing 100 copies of the halftone chart, the inventors of the present invention measured the toner discharge rate in the above-described procedures.

Six types of the linear velocity ratios V2/V1 at the charge nip after the change in the toner discharging operation were prepared and evaluated through the above-described tests. Table 1 shows the results of the tests.

TABLE 1

| Test | Linear Velocity V2 of Brush after Change of Toner Discharge (mm/sec) | Absolute Value of Change Amount of Linear Velocity V2 (Percentage and Rate of Change) | Ratio of Linear Velocity of Charge Nip after Change (V2/V1) | Rate of Toner Discharge (%) |
|---|---|---|---|---|
| A | 130 | 30% up | 1.3 | 5 |
| B | 150 | 50% up | 1.5 | 7 |
| C | 170 | 70% up | 1.7 | 7 |
| D | 70 | 30% down | 0.7 | 8 |
| E | 50 | 50% down | 0.5 | 9 |
| F | 30 | 70% down | 0.3 | 18 |

In the results shown in Table 1, the rates of the toner discharge in Tests A, B, C, D, E, and F were respective average rates of each toner discharge rate obtained through the test conducted for three times under the same conditions.

The results of Tests A, B, and C show that an increase of the linear velocity of the charging brush roller 4K caused the linear velocity ratio V2/V1 at the charge nip after the change to increase more than the linear velocity ratio V2/V1 at the charge nip before the change. That is, the linear velocity ratios V2/V1 in Tests A, B, and C were greater than 1, which is the linear velocity ratio V2/V1 before the change.

By contrast, the results of Tests D, E, and F show that a decrease of the linear velocity of the charging brush roller 4K caused the linear velocity ratio V2/V1 at the charge nip after the change to decrease less or smaller than the linear velocity ratio V2/V1 at the charge nip before the change. That is, the linear velocity ratios V2/V1 in Tests D, E, and F were smaller than 1, which is the linear velocity ratio V2/V1 before the change.

Then, the inventors of the present invention evaluated combinations of two tests that have a same absolute amount of change of the linear velocity V2 of the charging brush roller 4K. Specifically, the inventors evaluated a combination of Test A and Test D, a combination of Test B and Test E, and a combination of Test C and Test F, and found that the linear velocity ratio V2/V1 at the charge nip smaller than 1 (Tests D, E, and F) obtained the toner discharge rate higher than the linear velocity ratio V2/V1 at the charge nip greater than 1 (Tests A, B, and C). It is believed that, when the velocity ratio V2/V1 at the charge nip is decreased, the fibrous members 6K of the charging brush roller 4K significantly bend or obliquely slant, and the side surfaces of the fibrous members 6K are preferably held in contact with the surface of the photoconductor 3K.

Then, the inventors of the present invention conducted six tests, Tests 1 through 6, under the condition in which the linear velocity ratio V2/V1 at the charge nip was changed gradually or over time. The purpose of the tests was to evaluate the change of the toner discharge rate.

Referring to FIGS. 4 through 9, graphs show respective changes over time of the linear velocity V1 or the travel speed of the surface of the photoconductor 3K for black toner and the linear velocity V2 or the travel speed of the surface of the charging brush roller 4K for black toner in the respective tests.

Figure 4:
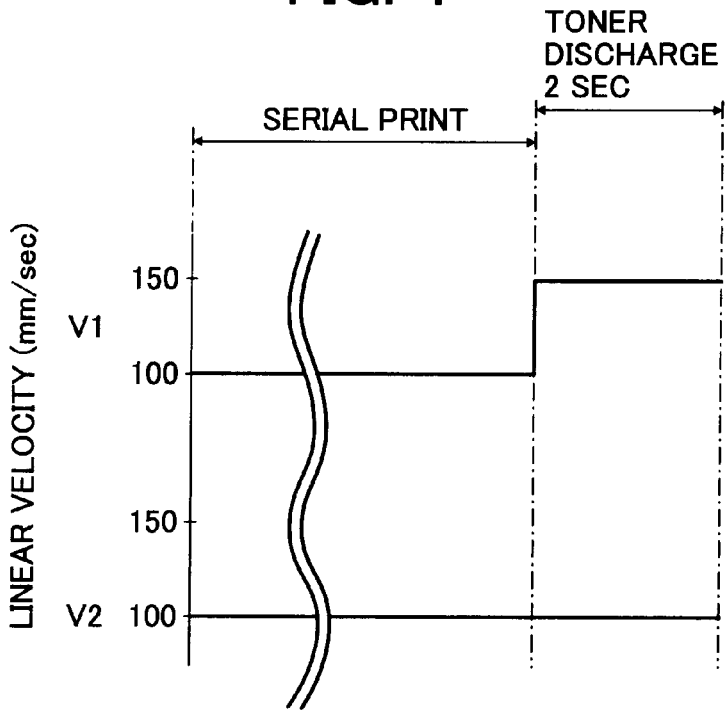
FIG. 4 is a graph showing changes over time of a linear velocity of a surface of a photoconductor provided in the process unit of FIG. 3 and a linear velocity of a surface of a charging brush roller provided in the process unit of FIG. 3 in Test 1.

FIG. 4 is the graph showing the change over time of the linear velocity V1 of the surface of the photoconductor 3K and the linear velocity V2 of the surface of the charging brush roller 4K in Test 1.

As shown in FIG. 4, during the serial printing operation in Test 1 for sequentially reproducing 100 copies of the halftone chart, each of the photoconductor 3K and the charging brush roller 4K was rotated at the linear velocity of 100 mm/sec. Then, at the start of the toner discharging operation, the linear velocity V2 of the charging brush roller 4K was rapidly increased or climbed upward from 100 mm/sec to 150 mm/sec, which was same as the previous Test B.

Figure 5:
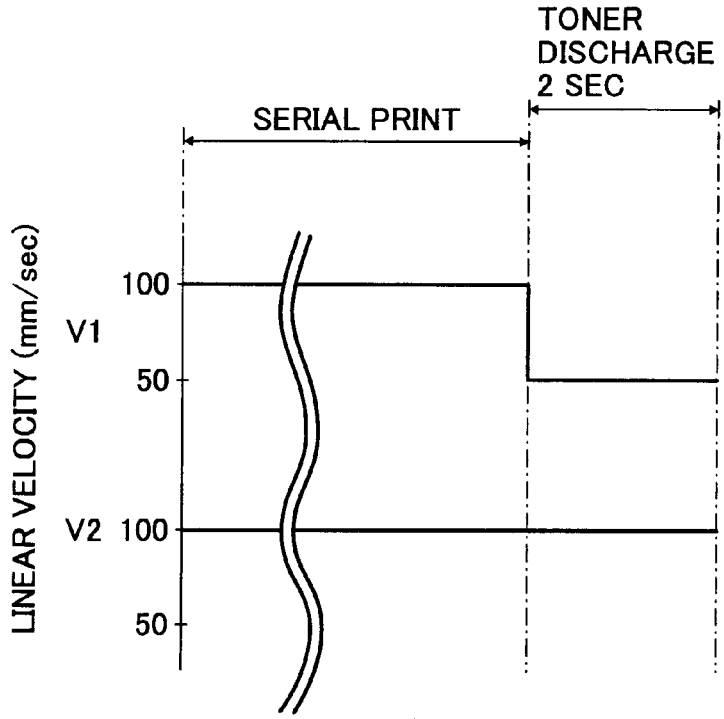
FIG. 5 is a graph showing changes over time of the linear velocity of the surface of the photoconductor and the linear velocity of the surface of the charging brush roller in Test 2.

FIG. 5 is the graph showing the change over time of the linear velocity V1 of the surface of the photoconductor 3K and the linear velocity V2 of the surface of the charging brush roller 4K in Test 2.

As shown in FIG. 5, during the serial printing operation in Test 2 for sequentially reproducing 100 copies of the halftone chart, each of the photoconductor 3K and the charging brush roller 4K was also rotated at the linear velocity of 100 mm/sec. However, at the start of the toner discharging operation, the linear velocity V2 of the charging brush roller 4K was sharply decreased or dropped from 100 mm/sec to 50 mm/sec, which was same as the previous Test E.

Figure 6:
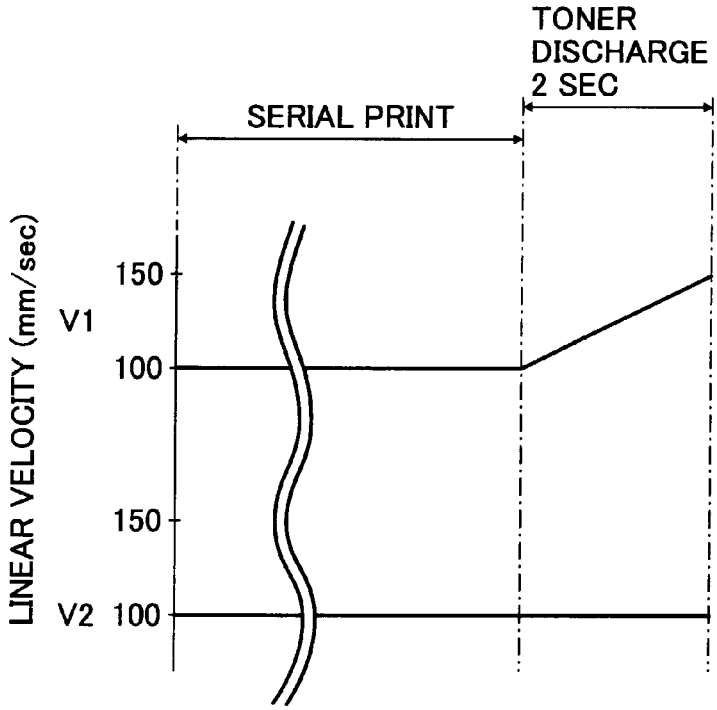
FIG. 6 is a graph showing changes over time of the linear velocity of the surface of the photoconductor and the linear velocity of the surface of the charging brush roller in Test 3.

FIG. 6 is the graph showing the change over time of the linear velocity V1 of the surface of the photoconductor 3K and the linear velocity V2 of the surface of the charging brush roller 4K in Test 3.

As shown in FIG. 6, during the serial printing operation in Test 3 for sequentially reproducing 100 copies of the halftone chart, each of the photoconductor 3K and the charging brush roller 4K was also rotated at the linear velocity of 100 mm/sec. However, during the toner discharging operation, the inventors took two seconds to cause the linear velocity V2 of the charging brush roller 4K to gradually increase from 100 mm/sec to 150 mm/sec.

Figure 7:
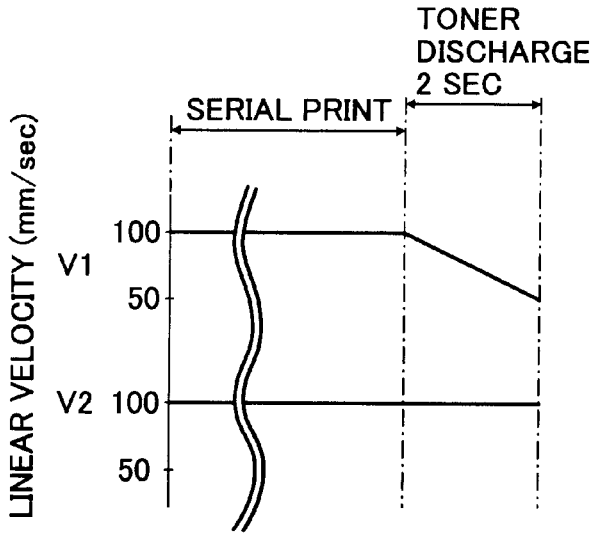
FIG. 7 is a graph showing changes over time of the linear velocity of the surface of the photoconductor and the linear velocity of the surface of the charging brush roller in Test 4.

FIG. 7 is the graph showing the change over time of the linear velocity V1 of the surface of the photoconductor 3K and the linear velocity V2 of the surface of the charging brush roller 4K in Test 4.

As shown in FIG. 7, during the serial printing operation in Test 4 for sequentially reproducing 100 copies of the halftone chart, each of the photoconductor 3K and the charging brush roller 4K was also rotated at the linear velocity of 100 mm/sec. However, during the toner discharging operation, the inventors took two seconds to cause the linear velocity V2 of the charging brush roller 4K to gradually decrease from 100 mm/sec to 50 mm/sec.

Figure 8:
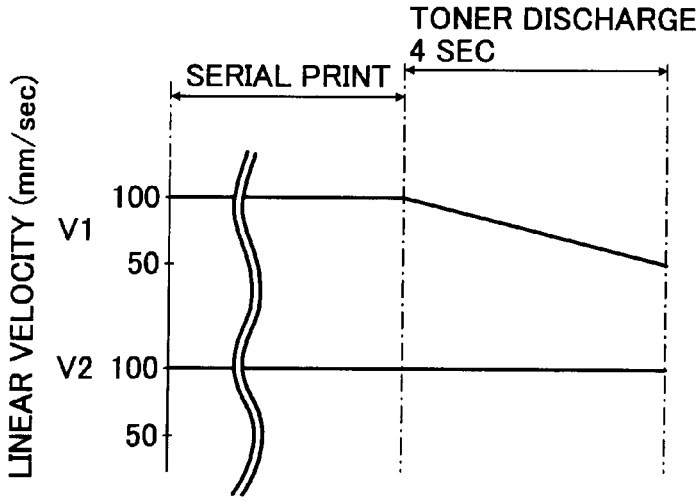
FIG. 8 is a graph showing changes over time of the linear velocity of the surface of the photoconductor and the linear velocity of the surface of the charging brush roller in Test 5.

FIG. 8 is the graph showing the change over time of the linear velocity V1 of the surface of the photoconductor 3K and the linear velocity V2 of the surface of the charging brush roller 4K in Test 5.

As shown in FIG. 8, during the serial printing operation in Test 5 for sequentially reproducing 100 copies of the halftone chart, each of the photoconductor 3K and the charging brush roller 4K was also rotated at the linear velocity of 100 mm/sec. However, during the toner discharging operation, the inventors took four seconds to cause the linear velocity V2 of the charging brush roller 4K to gradually decrease from 100 mm/sec to 50 mm/sec.

Figure 9:
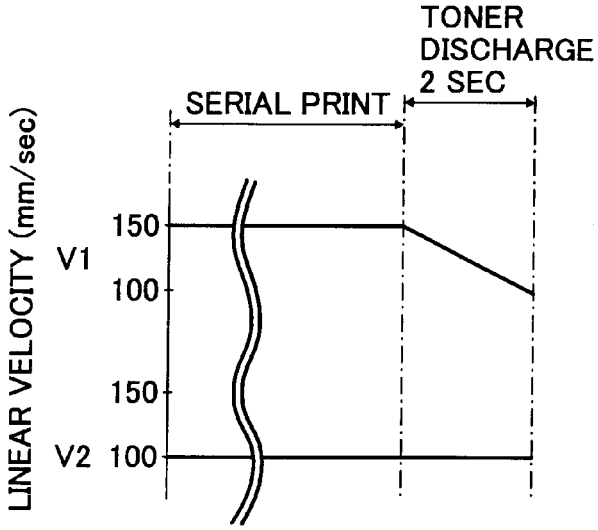
FIG. 9 is a graph showing changes over time of the linear velocity of the surface of the photoconductor and the linear velocity of the surface of the charging brush roller in Test 6.

FIG. 9 is the graph showing the change over time is the linear velocity V1 of the surface of the photoconductor 3K and the linear velocity V2 of the surface of the charging brush roller 4K in Test 6.

As shown in FIG. 9, during the serial printing operation in Test 6 for sequentially reproducing 100 copies of the halftone chart, the photoconductor 3K was rotated at the linear velocity V1 of 100 mm/sec and the charging brush roller 4K was rotated at the linear velocity V2 of 150 mm/sec. In addition, during the toner discharging operation, the inventors took two seconds to cause the linear velocity V2 of the charging brush roller 4K to gradually decrease from 150 mm/sec to 100 mm/sec.

Table 2 shows results of relationships of the linear velocity V1 of the photoconductor 3K and the linear velocity V2 of the charging brush roller 4K and the linear velocity ratio V2/V1 at the charge nip in the serial printing operation in Tests 1 through 6.

TABLE 2

| Test No. | Linear Velocity [mm/sec] V1 (Photoconductor) | Linear Velocity [mm/sec] V2 (Charging Brush Roller) | Ratio of Linear Velocities of Charge Nip (V2/V1) |
|---|---|---|---|
| 1 | 100 | 100 | 1 |
| 2 | 100 | 100 | 1 |
| 3 | 100 | 100 | 1 |
| 4 | 100 | 100 | 1 |
| 5 | 100 | 100 | 1 |
| 6 | 100 | 150 | 1.5 |

* When a serial printing operation is conducted.

Table 3 shows results of relationships of the linear velocity V1 of the photoconductor 3K and the linear velocity V2 of the charging brush roller 4K and the linear velocity ratio V2/V1 at the charge nip in the toner discharging operation in Tests 1 through 6.

TABLE 3

| Test No. | Linear Velocity [mm/sec] V1 (Photoconductor) | Linear Velocity [mm/sec] V2 (Charging Brush Roller) | Ratio of Linear Velocities of Charge Nip (V2/V1) |
|---|---|---|---|
| 1 | 100 | 150 | 1.5 |
| 2 | 100 | 50 | 0.5 |
| 3 | 100 | 150 | 1.5 |
| 4 | 100 | 50 | 0.5 |
| 5 | 100 | 50 | 0.5 |
| 6 | 100 | 100 | 1 |

*When a toner discharging operation is conducted.

Table 4 shows results of relationships of the toner discharge rate and increase/decrease of the linear velocity ratio V2/V1. Each toner discharge rate is an average rate obtained through the test conducted for three times under the same conditions.

TABLE 4

| Test No. | Toner Discharge Rate [%] 2 sec. after Start | Toner Discharge Rate [%] 4 sec. after Start | Increase/Decrease of Ratio of Linear Velocities (Printing Operation to Toner Discharging Operation) |
|---|---|---|---|
| 1 | 7 | — | Increase |
| 2 | 9 | — | Decrease |
| 3 | 11 | — | Increase |
| 4 | 35 | — | Decrease |
| 5 | 25 | 34 | Decrease |
| 6 | 20 | — | Decrease |

The inventors of the present invention compared the results of Tests 1 and 2 and the results of Tests 3 and 4 in Table 4 and learned that, when the surface of the charging brush roller 4K travels in a same direction as the surface of the photoconductor 3K at the charge nip, a lower linear velocity ratio at the charge nip can cause a higher toner discharge rate. This is different when the surface of the charging brush roller 4K travels in an opposite direction to the surface of the photoconductor 3K at the charge nip. It is believed that, as the linear velocity ratio V2/V1 at the charge nip decreases, a greater portion of each fibrous member of the charging brush roller 4K contacts the surface of the photoconductor 3K than the leading edge of each fibrous member thereof. That is, not only the leading edge of each fibrous member of the charging brush roller 4K but also a greater portion or area of the fibrous member thereof that includes the leading edge and a portion slightly away from the leading edge thereof contact the surface of the photoconductor 3K according to the decrease of the linear velocity ratio at the charge nip. Accordingly, the toner discharge rate can increase when the linear velocity ratio V2/V1 at the charge nip decreases.

Further, the inventors of the present invention compared the results of Tests 2 and 4 in Tables 2, 3, and 4 and learned that the toner discharge rate can be more increased when the linear velocity ratio at the charge nip is gradually decreased in a given period than when the linear velocity ratio at the charge nip is rapidly decreased in a short period. However, according to the comparison of the results of Tests 4 and 5, when a longer time is taken for the decrease of the linear velocity ratio at the charge nip, the toner discharging operation may also take a longer time. According to the result of Test 4, a preferable toner discharge rate can be achieved in a relatively short period under the condition in which the linear velocity ratio V2/V1 at the charge nip is sequentially decreased for two seconds so as to reduce the ratio V2/V1 to half of the original ratio.

The inventors also found according to the result of Test 6 that, even when the linear velocity V2 of the charging brush roller 4K is greater than the linear velocity of the photoconductor 3K while the charging brush roller 4K is rotated, a decrease of the linear velocity ratio V2/V1 at the charge nip in the toner discharging operation can obtain a higher toner discharge rate when compared with an increase of the linear velocity ratio V2/V1 at the charge nip.

Further, in any result of Tests A through F and Tests 1 through 6, a peak concentration of toner discharge was obtained when the charging brush roller 4K rotated one or two cycles after the linear velocity ratio V2/V1 at the charge nip was gradually changed. The peak concentration of the toner discharge is a peak concentration based on results obtained by taking steps of starting to change the linear velocity ratio V2/V1 at the charge nip, stopping the rotation of the photoconductor 3K at the completion of one cycle, discharging toner adhering to the circumferential surface of the photoconductor 3K onto an adhesive tape, and evaluating image density of the adhesive tape.

Next, details of the configuration of the printer 100 are described.

Figure 10:
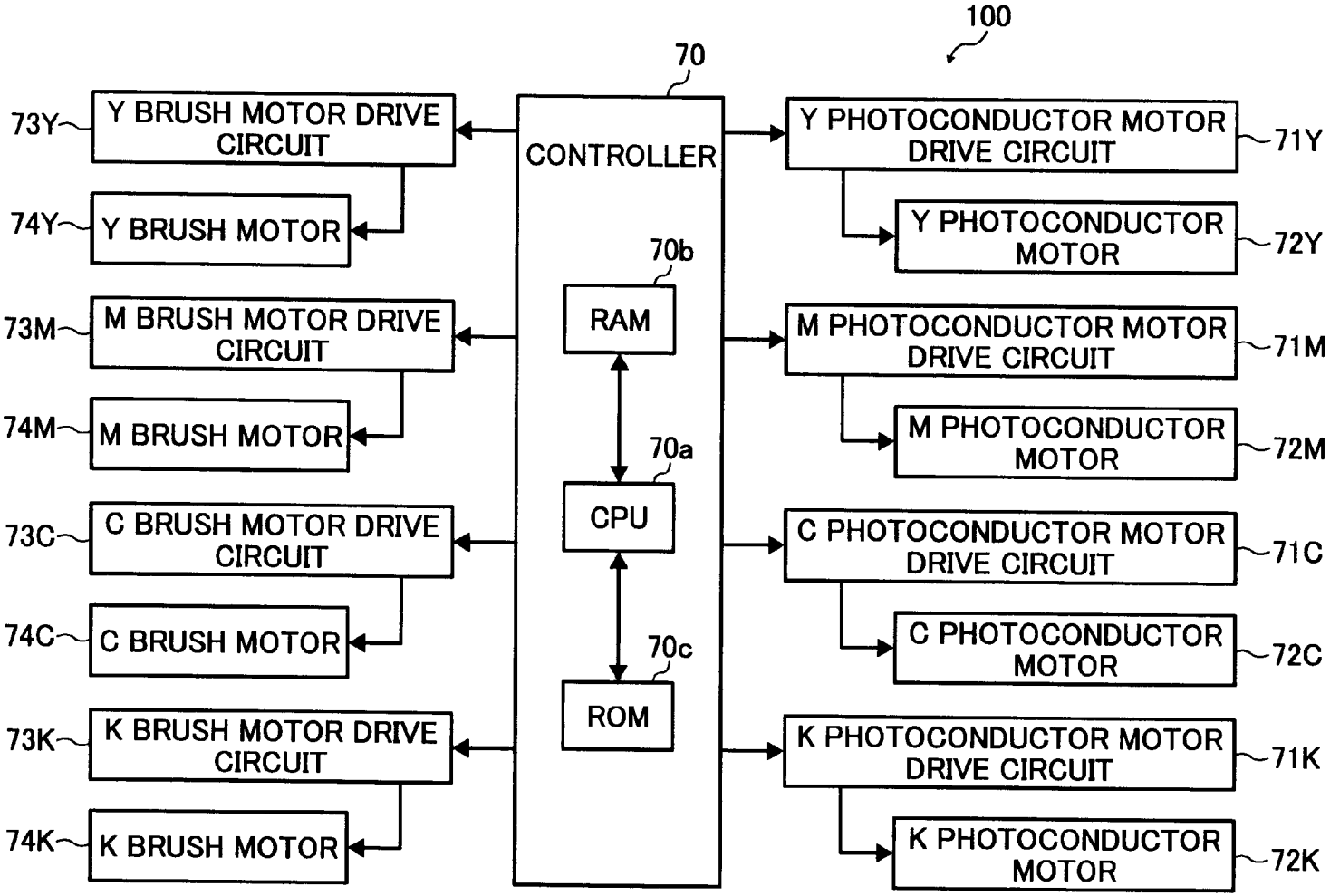
FIG. 10 is a block diagram of a portion of electrical circuit of the image forming apparatus of FIG. 2.

FIG. 10 shows a block diagram of a portion of electrical circuit of the printer 100.

In FIG. 10, a controller 70 of the printer 100 includes a central processing unit or CPU 70*a* serving as an operating unit, a random access memory or RMA 70*b* serving as a data storing unit, a read-only memory or ROM 70*c* serving as an operating unit. Based on control programs stored in RAM 70*c*, the controller 70 may control drives of various devices or units. Even through it is not shown in FIG. 10, the controller 70 is connected to an optical writing control circuit for driving the optical writing unit 50 (see FIG. 2), the transfer unit 60 (see FIG. 2), a registration motor for driving the pair of registration rollers 54 (see FIG. 2), and so forth. The controller 70 controls the entire operations of the print 100.

The controller 70 is further connected to photoconductor motor drive circuits 71Y, 71M, 71C, and 71K.

The photoconductor motor drive circuits 71Y, 71M, 71C, and 71K are connected to photoconductor motors 72Y, 72M, 72C, and 72K, respectively, to control driving operation and rotation speed of each of the photoconductor motors 72Y, 72M, 72C, and 72K, based on respective control signals sent from the controller 70. The photoconductor motors 72Y, 72M, 72C, and 72K are respective driving sources for driving the photoconductors 3Y, 3M, 3C, and 3K, respectively, and include respective DC brushless motor in the printer 100. The photoconductor motors 72Y, 72M, 72C, and 72K can flexibly change the respective rotation speeds based on respective drive signals sent from the photoconductor motor drive circuits 71Y, 71M, 71C, and 71K.

The controller 70 is further connected to brush motor drive circuits 73Y, 73M, 73C, and 73K.

The brush motor drive circuits 73Y, 73M, 73C, and 73K are connected to brush motors 74Y, 74M, 74C, and 74K, respectively, to control driving operation and rotation speed of the brush motors 74Y, 74M, 74C, and 74K, based on respective control signals sent from the controller 70. The brush motors 74Y, 74M, 74C, and 74K are respective driving sources for driving the charging brush rollers 4Y, 4M, 4C, and 4K, respectively, and include respective DC brushless motor in the printer 100. The brush motor drive circuits 73Y, 73M, 73C, and 73K can flexibly change the respective rotation speeds based on respective drive signals sent from the brush motor drive circuits 73Y, 73M, 73C, and 73K.

Accordingly, the printer 100 can separately control the driving speed or linear velocity V1 of each of the photoconductors 3Y, 3M, 3C, and 3K and the driving speed or linear velocity V2 of each of the charging brush rollers 4Y, 4M, 4C, and 4K.

As previously described, the printer 100 applies a charge bias of direct current voltage of −1100V to the charging brush rollers 4Y, 4M, 4C, and 4K of the process units 1Y, 1M, 10, and 1K, respectively, during the image forming operation, so that the photoconductors 3Y, 3M, 3C, and 3K can uniformly be charged to a negative polarity.

Further, as shown in FIG. 3, the printer 100 includes a drum cleaning unit 20Y in the process unit 1Y to remove residual toner adhering to the surface of the photoconductor 3Y after passing the primary transfer nip. However, the drum cleaning unit 20Y, for example, cannot completely remove such residual toner. That is, the residual toner can fall into the process unit 1Y after the removing operation by the drum cleaning unit 20Y has been conducted. Especially, the residual toner includes a toner particle having a small diameter and a high circularity and prepared by a polymerization method, such a toner particle can easily fall from the photoconductor 3Y to the inside of the process unit 1Y. Such residual toner may enter into the charge nip at which the charging brush roller 4Y and the photoconductor 3Y contact to each other. Then, the reversely charged toner of the residual toner is attracted to the brush portion of the charging brush roller 4Y. Thus, while the process unit 1Y performs the printing operations, such reversely charged toner may be gradually accumulated in the charging brush roller 4Y.

The controller 70, which is a drive control unit of the printer 100, controls a reduction of the linear velocity ratio for the toner discharge in the process unit 1Y at a given timing that is different from a timing during the printing operation or a timing at which the charging brush roller 4Y charges the surface of the photoconductor 3Y. That is, the controller 70 reduces at the charge nip at the above-described given timing the linear velocity ratio V2/V1 of the linear velocity V2 or a travel speed of the surface of the charging brush roller 4Y to the linear velocity V1 or a travel speed of the surface of the photoconductor 3Y.

During the reduction control of the linear velocity ratio V2/V1, the bias applied to the charging brush roller 4Y is charge from the charge bias of −1100V to the toner discharge bias of +200V so as to facilitate or promote the discharge of the reversely charged toner from the charging brush roller 4Y to the photoconductor 3Y. At the same time, the linear velocity ratio V2/V1 at the charge nip is caused to decrease to a ratio smaller than a ratio used in the printing operation. Specifically, during the printing operation, the photoconductor 3Y and the charging brush roller 4Y are rotated at a linear velocity of 100 mm/sec. On the contrary, during the reduction control of the linear velocity ratio V2/V1, while the photoconductor 3Y is constantly rotated at the linear velocity V1 of 100 mm/sec, the charging brush roller 4Y is firstly rotated at the linear velocity V2 of 100 mm/sec, then is rapidly decreased to 50 mm/sec. By so doing, the final linear velocity ratio V2/V1 at the charge nip during the reduction control of the linear velocity ratio can be set to 0.5:1.

When compared to the control in which the linear velocity ratio V2/V1 at the charge nip is abruptly increased or climbed upward during the toner discharging operation, the printer 100 having the above-described configuration can increase the toner discharge rate.

As previously described, the process units 1M, 1C, and 1K have the same functions and structures as the process unit 1Y. Accordingly, the above-described increase of the respective toner discharge rates may occur to the process units 1M, 1C, and 1K.

Next, further details of the printer 100 are described.

In the printer 100 according to an exemplary embodiment of the present invention, the photoconductors and the charging brush rollers are rotated at each linear velocity of 100 mm/sec during the printing operation. By contrast, during the reduction control of the linear velocity ratio V2/V1, the photoconductors are rotated at the linear velocity V1 of 100 mm/sec while the charging brush rollers are firstly rotated at the linear velocity V2 of 100 mm/sec, and the linear velocity V2 thereof are gradually decreased to 50 mm/sec in two seconds. Accordingly, the final linear velocity ratio V2/V1 at the charge nip during the reduction control of the linear velocity ratio may become 0.5:1.

With such a structure, as shown in FIG. 7 and the results of Test 4 in Table 3, the toner discharge rate may be enhanced or increased when the linear velocity ratio at the charge nip is gradually reduced or decreased at an appropriate speed during the reduction control of the linear velocity ratio, compared with Test 2 in which the linear velocity ratio at the charge nip is sharply reduced or dropped. This can reduce or avoid image deterioration caused by the accumulation of toner to the charging brush roller.

Examples of timing to conduct the reduction control of the linear velocity ratio are the timing immediately after the start of driving each device or unit based on a print job instruction, the timing close to the completion of the print job, the timing of standing by for the print job instruction, the timing between sheets during a serial printing operation (the timing when a region provided between sheets on the surface of the photoconductor reaches the charge nip), and so forth. Further, when the number of copies reproduced in a serial printing mode reaches a given number, the serial printing operation may temporarily be stopped to conduct the reduction control of the linear velocity ratio.

In the printer 100 according to an exemplary embodiment of the present invention, each of the charging brush rollers 4Y, 4M, 4C, and 4K has multiple fibrous members, each having an outer diameter of 11 mm and a circumferential length of approximately 34.54 mm.

During the reduction control of the linear velocity ratio, the linear velocity V2 of each charging brush roller is gradually decreased or decreased over time from 100 mm/sec to 50 mm/sec in two seconds. That is, the reduction control of the linear velocity ratio V2/V1 may be conducted for at least two seconds. During the reduction control of the linear velocity ratio V2/V1, the travel distance of the surface of the charging brush roller is approximately 150 mm, which corresponds to approximately 4.3 cycles. Therefore, the toner discharging operation may be conducted for the circumference of the charging brush roller. Thus, during the reduction control of the linear velocity ratio V2/V1, it is desirable to cause the surface of the charging brush roller to travel or move for one cycle or more. Accordingly, the movement of the surface of the charging brush roller for one or more cycle can avoid the accumulation of toner to the charging brush roller that is caused by not performing the toner discharging operation to a region on the circumferential surface of the charging brush roller.

The above-described example has been made when the charging brush roller is employed as a charging member. However, it is not limited to the charging brush roller to perform the above-described example. As an alternative to the charging brush roller, it is possible to use a charge roller.

Figure 11:
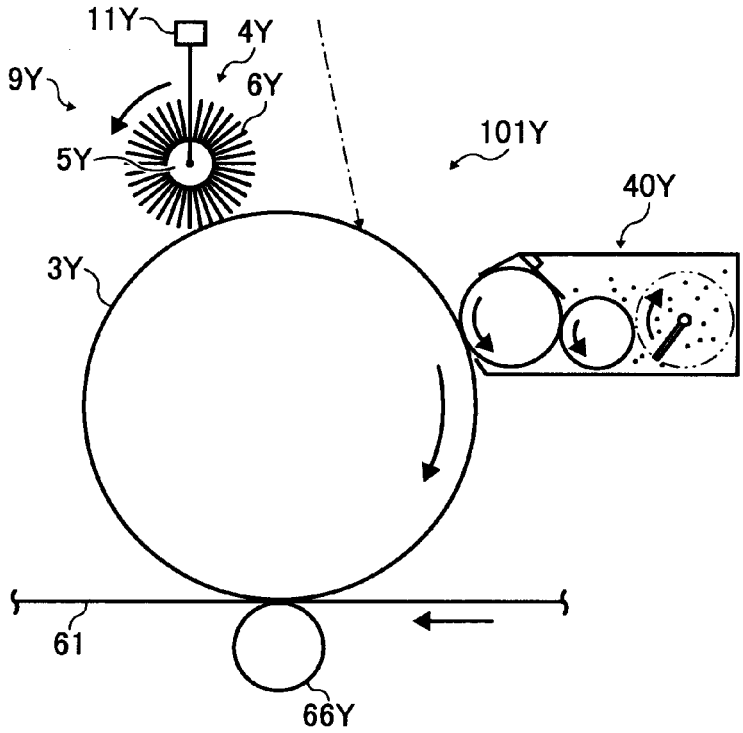
FIG. 11 is a schematic configuration of a different process unit that can be provided to the image forming apparatus of FIG. 2 according to a first modified exemplary embodiment of the present invention.

Referring to FIG. 11, a schematic configuration of a process unit 101Y for yellow toner provided to the printer 100 according to a first modified exemplary embodiment of the present invention is described. The other process units 101M, 101C, and 101K, not shown, in the printer 100 have similar structures and functions to the process unit 101Y, except the colors of toners accommodated therein.

The process unit 101Y of the printer 100 according to the first modified exemplary embodiment of the present invention employs a so-called "cleaner-less system." The cleaner-less system can perform an image forming process without using a dedicated unit for collecting residual toner from the surface of a photoconductor, i.e., the photoconductor 3Y. In other words, the cleaner-less system does not require a toner collecting unit or a cleaning unit. Specifically, after removing residual toner from the surface of the photoconductor, the cleaner-less system conveys and collects the residual toner to a toner container or to a developing unit for reusing, without causing the residual toner to return to the image carrier. The dedicated unit for collecting residual toner includes a cleaning blade, for example the cleaning blade 21Y shown in FIG. 3.

Details of such a cleaner less system are described below.

There are generally three types of cleaner-less systems, which are spread type, catch-and-release type, and combination type that uses both the spread type and catch-and-release type.

The spread type cleaner-less system uses a toner spreading member such as a brush for slidably contacting a photoconductor. With the spread type cleaner-less system, the toner spreading member may scrape and/or spread residual toner on the photoconductor to reduce adherence of the residual toner with respect to the photoconductor. The residual toner remaining on the surface of the photoconductor is then electrostatically attracted by a developing member, (for example, a development sleeve and a developing roller) at or before a development region in which the developing member and the photoconductor are disposed opposite to each other. By so doing, the residual toner can be collected by the developing unit.

Before being collected by the developing unit, the residual toner passes a position at which an electrostatic latent image is optically formed. When the residual toner on the photoconductor is a relatively small amount, an adverse affect may not be exerted for forming the electrostatic latent image. However, when the residual toner contains toner particles that are charged to a polarity opposite to the proper polarity of the toner, the developing member cannot attract such oppositely charged toner particles contained in the residual toner. This may cause a defected image with a background contamination, for example.

To reduce or eliminate the occurrence of background contamination caused by the above-described oppositely charged toner, it is preferable to arrange a toner charging unit for charging the residual toner remaining on the surface of the photoconductor to the proper polarity of the toner between a transfer position (e.g., primary transfer nip) and a toner spreading position at which the residual toner is spread by the toner spreading member or between the toner spreading position and a development position.

Possible toner spreading members are, for example, a fixed brush with multiple conductive fibrous members attached to a metal plate, a unit casing, etc., a brush roller with multiple fibrous members arranged perpendicular to a surface of a metallic rotary shaft, a roller including an electrically conductive sponge body, and so forth.

The fixed brush can be formed with a relatively small amount of fibrous members, which may be less expensive. However, when the fixed brush is also used as a charging member for uniformly charging the surface of the photoconductor, the fixed brush cannot provide a sufficient uniformity in charging. Compared with the fixed brush, the brush roller is more suitable for a sufficient uniformity in charging.

The catch-and-release type cleaner-less system can use a rotating brush that moves continuously while contacting the surface thereof with the photoconductor. In this case, the rotating brush serves as a catch-and-release member.

The rotating brush temporarily catches the residual toner from the surface of the photoconductor. At a given timing, e.g., at a timing after a print job or at a timing between sheet processing operations during the print job, the residual toner caught on the rotating brush is released and transferred onto the surface of the photoconductor again. Then, the developing member electrostatically attracts the residual toner to collect into the developing unit.

A relatively large amount of residual toner remains on the photoconductor after a solid image has been formed or a jam has occurred. In such case, the spread type cleaner-less system may cause image deterioration due to the overload to the developing member. On the contrary, the catch-and-release type cleaner-less system can avoid the occurrence of such image deterioration by collecting the residual toner from the rotating brush to the developing member little by little.

The combination type cleaner-less system can use both functions of the spread type system and the catch-and-release type system.

Specifically, a rotary brush member which contacts the photoconductor or other similar latent image carrying member is used to perform as a toner spreading member as well as a catch-and-release member. While serving as a toner spreading member when only a DC voltage is applied, the rotary brush member may serve as a catch-and-release member, when necessary, by switching the bias from a DC bias voltage to an AC bias voltage superimposed on a DC bias voltage.

In FIG. 11, the process unit 101Y according to the modified exemplary embodiment of the present invention employs the catch-and-release type cleaner-less system. Specifically, while rotating at a given linear velocity in a clockwise direction in FIG. 11, the photoconductor 3Y contacts an outer surface of the intermediate transfer belt 61 to form a primary nip for yellow toner images. The fibrous members 6Y of the charging brush roller 4Y applies a charge bias to the photoconductor 3Y to uniformly charge the surface of the photoconductor 3Y to a minus polarity. At the same time, by the previously described action of the charge bias, residual toner remaining on the surface of the photoconductor 3Y is caught by the multiple fibrous members 6Y of the charging brush roller 4Y. Then, at a given timing, e.g., at a timing after a print job or at a timing between sheet processing operations during the print job, the residual toner caught on the multiple fibrous members 6Y while rotating is released and discharged onto the surface of the photoconductor 3Y again. Then, the developing roller 42Y electrostatically attracts the residual toner to convey into the developing unit 40Y.

Figure 12:
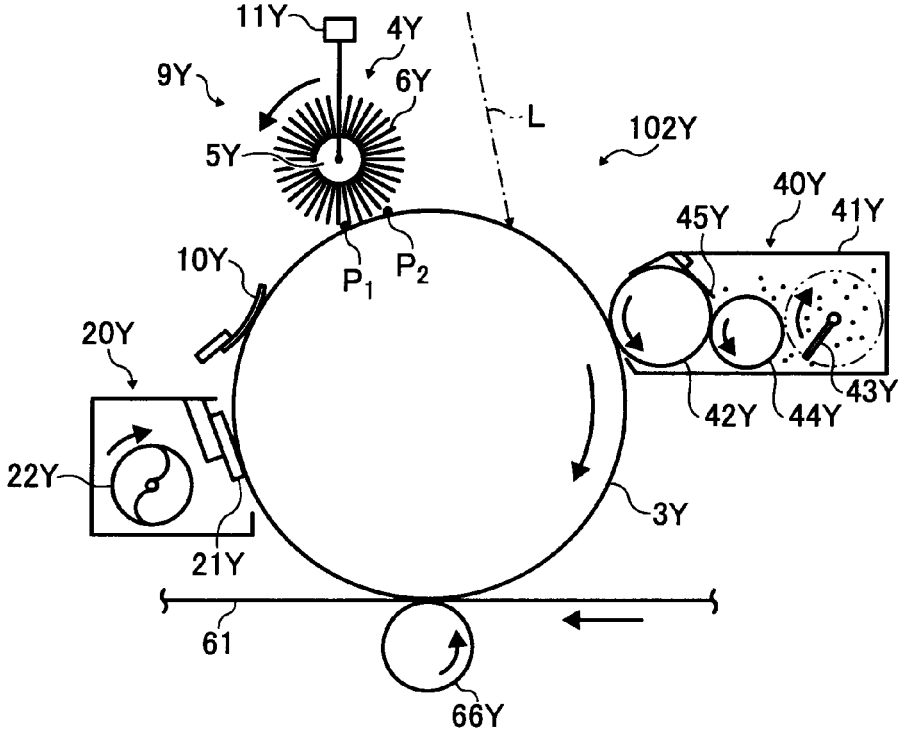
FIG. 12 is a schematic configuration of a different process unit that can be provided to the image forming apparatus of FIG. 2 according to a second modified exemplary embodiment of the present invention.

Referring to FIG. 12, a schematic structure of a process unit 102Y for yellow toner of the printer 100 according to a second modified exemplary embodiment of the present invention is described. The other process units 102M, 102C, and 102K, not shown, in the printer 100 have similar structures and functions to the process unit 102Y, except the colors of toners accommodated therein.

Similar to the first modified exemplary embodiment, the process unit 102Y of the printer 100 according to the second modified exemplary embodiment of the present invention employs a structure with the cleaner-less system, except that the charge bias applied to the charging brush roller 4Y is different from the charge bias used in the first modified exemplary embodiment.

In the second modified exemplary embodiment of the present invention, the charge bias includes a superimposed voltage having an alternating current voltage or AC voltage superimposed on a direct current voltage or DC voltage Vdc. The AC voltage has a peak-to-peak voltage Vpp of 1.0 kV, a printing frequency of 300 Hz, a non-printing frequency, or a frequency of a non-printing area between the trailing edge of a sheet and the leading edge of the following sheet, of 10 Hz, and a duty of 45%. The DC voltage Vdc is −500V.

The above-described process unit 102Y of the printer 100 may cause the charging brush roller 4Y to rotate with the photoconductor 3Y at the charge nip, which can reduce the size of each drive motor and the costs for the printer 100. In addition, the above-described process unit 102Y of the printer 100 may reduce the occurrence of charging non-uniformity in local regions on the surface of the photoconductor 3Y.

Regardless of the travel direction of the surface of a charging member such as the charging brush roller 4Y and the surface of the photoconductor 3Y at the charge nip or whether the surface of the charging brush roller 4Y and the surface of the photoconductor 3Y travel at the charge nip in a same direction or an opposite direction, electrical discharge may occur between the charging brush roller 4Y and the photoconductor 3Y, mainly on the charging brush roller 4Y at a point immediately before the charge nip.

In the structure in which a charging member and a photoconductor at the charge nip travel in an opposite direction, an entrance of the charge nip for the charging member corresponds to an exit of the charge nip for the photoconductor. That is, the exit of the charge nip for the photoconductor is located in the vicinity of a position at which electrical charge caused by electrical discharge occurs the most. The surface of the photoconductor charged at the above-described position travels to the opposite direction to the charge nip to be irradiated by an optical writing unit, i.e., the optical writing unit 50. Then, the charge condition over the surface of the photoconductor immediately before the exposing operation may substantially depend on the status of electrical discharge in the vicinity of the exit of the charge nip for the photoconductor.

The condition of the photoconductor may be acceptable when the electrical discharge uniformly occurs in the vicinity of the exit of the charge nip for the photoconductor. On the other hand, when the electrical resistance value of the charging member has non-uniformity, excessive electrical discharge may occur at a local region or local regions on which the electrical resistance value is relatively low. Accordingly, the excessive electrical discharge can easily occur at local regions on the surface of the photoconductor.

By contrast, the process unit 102Y of FIG. 12 can reduce or avoid the above-described charging non-uniformity.

In FIG. 12, a point P1 indicates an entrance of the charge nip for the photoconductor 3Y of the process unit 102Y and a point P2 indicates an exit of the charge nip for the photoconductor 3Y. The point P1 is also an entrance of the charge nip for the charging brush roller 4Y and the point P2 is an exit of the charge nip for the charging brush roller 4Y. The point P2 is located at an opposite side to the point P1.

In the above-described structure, when the charge by electrical discharge is performed the most at the point P1, an excessively charged portion can be generated in the vicinity of the point P1. Then, the excessively charged portion may reach the charge nip before the optical writing operation is performed.

In the second modified exemplary embodiment using the superimposed voltage as a charge bias, the polarity reversal of the voltage may cause the charge and discharge of the charge bias repeatedly with respect to the photoconductor 3Y in the charge nip in a short period.

According to the above-described operation, even when such an excessively charged portion is generated in the vicinity of the point P1, the excessive charge on the portion can be eliminated in the charge nip and the portion may uniformly be charged to pass the point P2. Accordingly, when compared with the structure that causes the surface of the charging member and the surface of the photoconductor to travel in the opposite direction to each other, the process unit 102Y having the structure that causes the surface travel direction of the charging brush roller 4Y and the photoconductor 3Y to travel in the same direction can reduce the occurrence frequency of local charging non-uniformity on the surface of the photoconductor 3Y.

In FIG. 12, the surface of the photoconductor 3Y after passing the primary transfer nip formed between the photoconductor 3Y and the primary transfer member 66Y via the intermediate transfer belt 61 may reach and enter a pre-charge nip that is a contact position of the photoconductor 3Y and a pre-charge contact sheet 10Y serving as a pre-charge contact member, and then reach and enter the charge nip to be uniformly charged.

The pre-charge contact sheet 10Y is supported in a cantilever manner. That is, one end of the pre-charge contact sheet 10Y is a fixed end and the other end thereof is a free end. The pre-charge contact sheet 10Y directs the free end thereof to a downstream side in the travel direction of the surface of the photoconductor 3Y and contacts the free end side with the surface of the photoconductor 3Y before uniformly charged.

A pre-charge bias including a DC voltage is applied to the pre-charge contact sheet 10Y via a pre-charge bias applying unit, not shown, including a power source, not shown, and wirings, not shown.

Reversely charged toner in the residual toner may enter into a pre-charge nip formed between the pre-charge contact sheet 10Y and the photoconductor 3Y. Due to electrical discharge in the pre-charge nip or due to charge injection from the pre-charge contact sheet 10Y, the reversely charged toner can be charged to a positive polarity.

In addition, low charge toner in the residual toner may be sufficiently charged to the regular polarity by the electrical discharge or the charge injection.

According to the above-described operations, after passing the pre-charge nip, the substantially entire amount of the residual toner adhering to the surface of the photoconductor 3Y can be charged to the regular polarity. When the above-described residual toner reaches and enters the charge nip, a part of the above-described residual toner may temporarily be caught by the fibrous members 6Y of the charging brush roller 4Y.

During the reduction control of the linear velocity ratio V2/V1, the frequency of an alternating current component of the charge bias including the superimposed voltage may be decreased from 300 Hz to 10 Hz. By so doing, the residual toner collected and temporarily held in the charging brush roller 4Y can be discharged onto the surface of the photoconductor 3Y. At this time, the linear velocity ratio at the charge nip is gradually reduced to promote the toner discharge from the charging brush roller 4Y.

Figure 13:
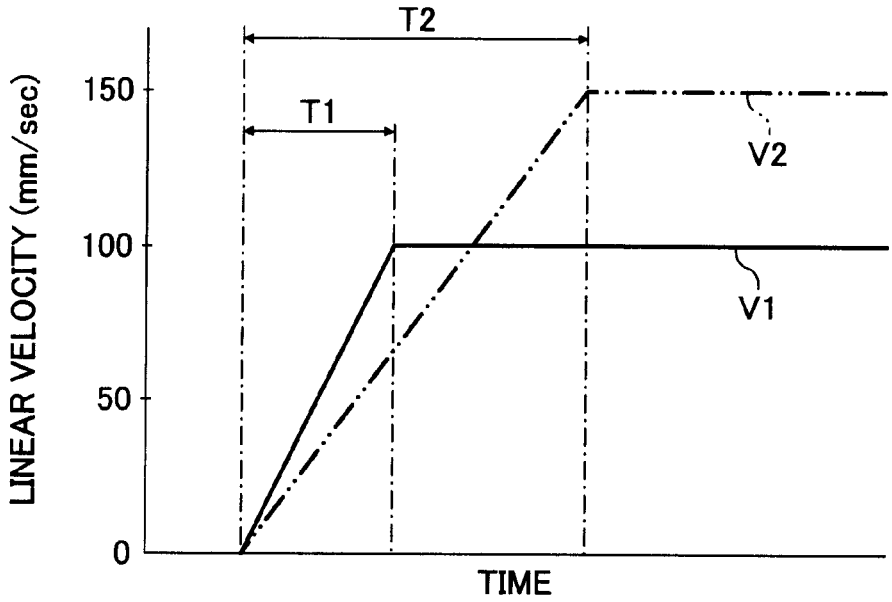
FIG. 13 is a graph showing the linear velocity of the image carrier and the linear velocity of the charging brush roller at a start of a print job performed in the image forming apparatus of FIG. 2.
Figure 14:
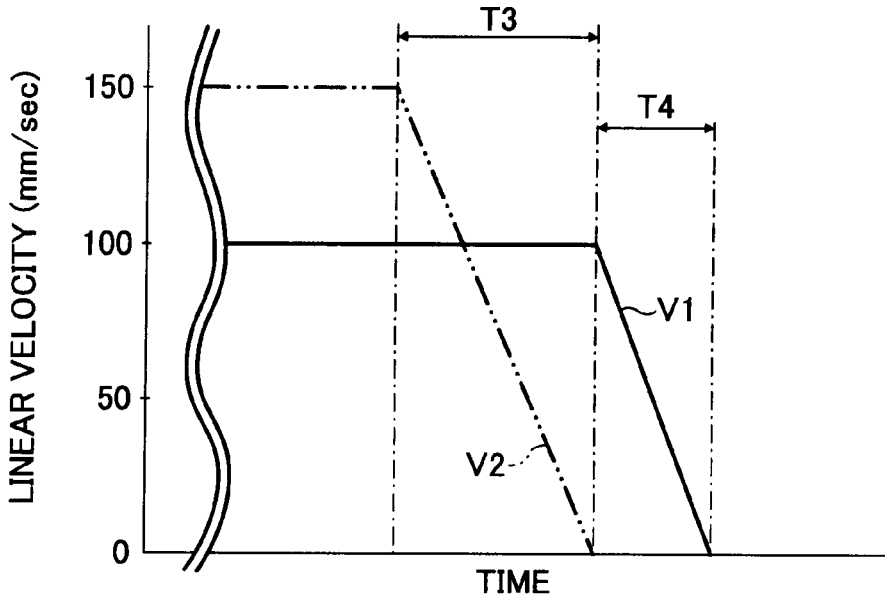
FIG. 14 is a graph showing the linear velocity of the image carrier and the linear velocity of the charging brush roller at an end of a print job performed in the image forming apparatus of FIG. 2.

Next, referring to FIGS. 13 and 14, detailed example settings of a printer, i.e., the printer 100, according to the above-described exemplary embodiments of the present invention are described.

Elements having the same functions and shapes are denoted by the same reference numerals throughout the specification and redundant descriptions are omitted.

In a first example setting of the printer 100, for example, a width of the charge nip, which indicates a distance of the charge nip in the surface travel direction, is in a range of from approximately 1 mm to approximately 5 mm.

To perform a preferable toner discharge of the charging brush roller 4Y to the photoconductor 3Y, the width of the charge nip or a charge nip width may need to be 1 mm or greater so that the toner on the charging brush roller 4Y can contact the surface of the photoconductor 3Y.

Further, when the charge nip width is greater than 5 mm, respective drive torques of the photoconductor motors and the brush motors may start to abruptly increase.

According to the above-described reasons, a preferable charge nip width is set in the range of from approximately 1 mm to approximately 5 mm.

A second example setting of the printer 100, for example, is described with reference to FIGS. 13 and 14.

FIG. 13 is a graph showing the linear velocity V1 of the photoconductor 3Y and the linear velocity V2 of the charging brush roller 4Y at the start of the printing operation or print job of the printer 100.

When the print job of the printer 100 starts, the photoconductor 3Y and the charging brush roller 4Y may be rotated in a substantially concurrent manner.

The photoconductor 3Y may increase the linear velocity V1 at a given acceleration within a time period T1 starting after the start of the rotation. When the time period T1 elapses, the photoconductor 3Y may be stabilized at the linear velocity V1 of 100 mm/sec.

By contrast, the charging brush roller 4Y may increase the linear velocity V2 at a given acceleration, which is greater than the given acceleration of the linear velocity V1, within a time period T2, which is longer than the time period T1 for the photoconductor 3Y. When the time period T2 elapses, the charging brush roller 4Y may be stabilized at the linear velocity V2 of 150 mm/sec.

As shown in the graph of FIG. 13, the acceleration of the photoconductor 3Y is greater than the acceleration of the charging brush roller 4Y in the time period T1. Therefore, the linear velocity ratio V2/V1 at the charge nip gradually decreases.

Thus, the printer 100 may perform the reduction control of the linear velocity ratio that gradually decreases or reduces the linear velocity ratio V2/V1 at the charge nip when starting to drive the photoconductor 3Y and the charging brush roller 4Y at the start of the print job. At this time, a toner discharge bias is applied to the charging brush roller 4Y to cause the toner held in the charging brush roller 4Y to be discharged therefrom.

FIG. 14 is a graph showing the linear velocity V1 of the photoconductor 3Y and the linear velocity V2 of the charging brush roller 4Y at the end of the printing operation or print job of the printer 100.

At the end of the print job of the printer 100, for example, the linear velocity V2 of the charging brush roller 4Y running at a constant speed of approximately 150 mm/sec may start to gradually decrease. Within a time period T3 starting after the start of decrease of the linear velocity V2 of the charging brush roller 4Y, the linear velocity V2 may gradually decrease at a given negative acceleration. When the time period T3 elapses, the rotation of the charging brush roller 4Y may stop. Immediately after the stoppage of the rotation of the charging brush roller 4Y, the photoconductor 3Y running at a constant speed of approximately 100 mm/sec may be caused to start to decrease the linear velocity V1. And, within a time period T4 starting after the linear velocity V1 has started to decrease, the linear velocity V1 of the photoconductor 3Y may gradually decrease at a given negative acceleration. When the time period T4 elapses, the rotation of the photoconductor 3Y may stop.

As shown in the graph of FIG. 14, while the linear velocity V2 of the charging brush roller 4Y gradually decreases, the linear velocity V1 of the photoconductor 3Y is stabilized at approximately 100 mm/sec. Therefore, during the time period T3, the linear velocity ratio V2/V1 at the charge nip may gradually decrease.

Accordingly, the printer 100, for example, may perform the reduction control of the linear velocity ratio that gradually decreases or reduces the linear velocity ratio V2/V1 at the charge nip when starting to drive the photoconductor 3Y and the charging brush roller 4Y at the end of the print job. Also at this time, a toner discharge bias is applied to the charging brush roller 4Y to cause the toner held in the charging brush roller 4Y to be discharged therefrom.

The printer 100 having the above-described structure uses the rise of driving motors at the start of the print job and the fall of driving motors at the end of the print job to perform the reduction control of the linear velocity ratio V2/V1. Accordingly, the operation for discharging toner from the charging brush roller 4Y can be conducted without imposing an unnecessary standby time on users.

In a third example setting of the printer 100, for example, each surface of the photoconductors 3Y, 3M, 3C, and 3K of the printer 100 has a friction coefficient in a range of from approximately 0.15 to approximately 0.5.

When the friction coefficient of the surface of the photoconductor 3Y, for example, is less than 0.15, it may be suddenly difficult to cause the toner to be discharged from the charging brush roller 4Y, for example, to the photoconductor 3Y, by contacting the surface of the charging brush roller 4Y to the surface of the photoconductor 3Y.

Further, when the friction coefficient of the surface of the photoconductor 3Y is greater than 0.5, the deterioration in the photoconductor 3Y may abruptly increase due to the contact with the fibrous members 6Y of the charging brush roller 4Y.

As described above, the present invention can be applied to a tandem-type color printer in which toner images formed by the multiple process units, i.e., the process units 1Y, 1M, 10, and 1K are sequentially transferred to form a full color image and superimposed onto a recording medium.

The present invention is similarly applicable to a single-type color image forming apparatus in which multiple developing units for different colors of toner are disposed around a single photoconductor drum such as an electrostatic image carrying member and sequentially switched to form each toner image on the single photoconductor so that the overlaid toner image can be transferred onto an intermediate transfer member.

The present invention is also applicable to an image forming apparatus having a monochrome printing method.

As described above, in an exemplary embodiment of the present invention, the controller 70 that is a drive control unit of the printer 100, for example, performs the reduction control of the linear velocity ratio so that the surface travel speed or the linear velocity V2 of the charging brush roller 4 that represents the charging brush rollers 4Y, 4M, 4C, and 4K serving as a charging member can be smaller than or below the surface travel speed or the linear velocity V1 of the photoconductor 3Y serving as an image carrier. In an exemplary embodiment of the present invention, the linear velocity V1 is 100 mm/sec and the linear velocity V2 is 50 mm/sec.

As shown in the results of Tests 4 and 6, the printer having the above-described configuration can enhance the toner discharge rate of the toner discharged from the charging brush roller 4, when compared to the configuration in which the surface travel speed or the linear velocity V2 of the charging brush roller 4 can be equal to or greater than the surface travel speed or the linear velocity V1 of the photoconductor 3 that represents the photoconductors 3Y, 3M, 3C, and 3K.

Further, the printer according to an exemplary embodiment of the present invention includes the controller 70 in which the linear velocity ratio V2/V1 at the charge nip is 0.5:1 or less during the reduction control of the linear velocity ratio V2/V1.

When compared to the configuration in which the linear velocity ratio V2/V1 at the charge nip abruptly increases during the toner discharging operation, the printer having the above-described configuration can increase the toner discharge rate of the toner discharged from the charging brush roller 4.

Further, the printer according to an exemplary embodiment of the present invention includes the controller 70 in which the surface of the charging brush roller 4 moves for one or more cycle, which is approximately 4.3 cycles, during the reduction control of the linear velocity ratio V2/V1. With the above-described structure, by not performing the toner discharging operation to a region on the circumferential surface of the charging brush roller, the accumulation of toner to the charging brush roller 4 can be avoided.

Further, in an exemplary embodiment of the present invention, a width of the charge nip or a distance of the charge nip in the surface travel direction of the photoconductor 3 and the charging brush roller 4 is in a range of from approximately 1 mm to approximately 5 mm. With the above-described configuration, the printer 100, for example, may avoid causing defective discharge of toner from the charging brush roller 4 due to lack of the charge nip width. In addition, the printer 100 with the above-described configuration can reduce or prevent, where possible, an unnecessary increase of the drive torques of the photoconductor motors and the brush motors due to excess of the charge nip width.

Further, the printer 100, for example, according to an exemplary embodiment of the present invention includes the charge bias applying unit including a power source and wiring, so that a charge bias having a positive DC voltage that is charged to an opposite polarity to the regular charge polarity of toner can be applied during the reduction control of the linear velocity ratio.

With the above-described configuration, the DC voltage charged to the positive polarity that is same as the reversely charged toner is applied so that the reversely charged toner (positive polarity) adhering to the charging brush roller 4 can be discharged therefrom.

Further, the printer according to an exemplary embodiment of the present invention includes the controller 70 in which the reduction control of the linear velocity ratio V2/V1 is conducted during the start of the print job or during starting driving the photoconductor 3 and the charging brush roller 4 and at an end of the print job or at an end of stopping driving the photoconductor 3 and the charging brush roller 4.

With the above-described structure, the reduction control of the linear velocity ratio can be performed by using the rise of driving motors at the start of the print job and the fall of driving motors at the end of the print job. Accordingly, the operation for discharging toner from the charging brush roller 4 can be conducted without imposing an unnecessary standby time on users.

Alternatively, the reduction control of the linear velocity ratio can be performed at a timing at least one of the start of the print job and the end of the print job.

That is, the controller 70 can reduce the linear velocity ratio V2/V1 either during starting the photoconductor 3 and the charging brush roller 4, at an end of stopping the photoconductor 3 and the charging brush roller 4, or both during starting the photoconductor 3 and the charging brush roller 4 and at the end of stopping the photoconductor 3 and the charging brush roller 4.

Further, in the printer according to an exemplary embodiment of the present invention, the charging brush roller 4 serving as a charging member includes the rotary shaft member 5 that represents the rotary shaft members 5Y, 5M, 5C, and 5K and the multiple fibrous members 6 that represents the multiple fibrous members 6Y, 6M, 6C, and 6K. The multiple fibrous members 6 are electrically conductive and mounted on the rotary shaft member 5 perpendicular to the surface of the rotary shaft member 5. The respective leading edges of the multiple fibrous members 6 contact the surface of the photoconductor 3.

With the above-described structure, residual toner adhering to the charging brush roller 4 may be held or kept with the multiple fibrous members 6 on the charging brush roller 4. By so doing, even through some amount of the residual toner is kept on the charging brush roller 4, the charging brush roller 4 can uniformly charge the surface of the photoconductor 3.

Further, in the printer according to an exemplary embodiment of the present invention, the photoconductor 3 has a friction coefficient of the surface thereof in a range of from approximately 0.15 to approximately 0.5. The photoconductor 3 can avoid causing defective discharge of toner from the charging brush roller 4 due to lack of a sliding force for slidably travel on the surface of the photoconductor 3 and, at the same time, avoid causing significant abrasion or wearing out of the photoconductor 3 due to an excess of the sliding force.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier configured to carry an image on a surface thereof and rotate continuously;

an image forming unit configured to form a latent image on the surface of the image carrier;

a developing unit configured to develop the latent image formed on the surface of the image carrier into a visible toner image;

a charging member including a charging brush roller configured to rotate continuously with the image carrier at a portion contacting the image carrier and uniformly charge the surface of the image carrier while contacting a surface thereof with the surface of the image carrier at a charge nip;

a charge bias applying unit configured to apply a charge bias to the charging member;

a controller configured to control driving of the image carrier and the charging member, wherein the controller reduces, at the charge nip at a given timing, a linear velocity ratio of a travel speed of the surface of the charging brush roller to a travel speed of the surface of the image carrier, and the surface of the charging brush roller and the surface of the image carrier move in a same direction at the charge nip;

the controller is further configured to decrease over time the linear velocity ratio at the charge nip during reduction of the linear velocity ratio; and the charge bias applying unit is further configured to apply a direct current voltage having a polarity opposite to a regular polarity of toner to the charging member during reduction of the linear velocity ratio.

2. The image forming apparatus according to claim 1, wherein the controller is configured to reduce the surface travel speed of the charging brush roller below the surface travel speed of the image carrier during reduction of the linear velocity ratio.

3. The image forming apparatus according to claim 2, wherein the controller is configured to change the linear velocity ratio at the charge nip to 0.5:1 or less during reduction of the linear velocity ratio.

4. The image forming apparatus according to claim 1, wherein the controller is configured to continuously move the surface of the charging brush roller during reduction of the linear velocity ratio for at least one cycle.

5. The image forming apparatus according to claim 1, wherein a length of a contact portion in a surface travel direction of the image carrier and the charging brush roller is in a range of from approximately 1 mm to approximately 5 mm.

6. The image forming apparatus according to claim 1, wherein the controller is configured to reduce the linear velocity ratio either during starting the image carrier and the charging member, at an end of stopping the image carrier and the charging member, or both during starting the image carrier and the charging member and at the end of stopping the image carrier and the charging member.

7. The image forming apparatus according to claim 1, wherein the charging brush roller includes a rotary shaft member and multiple electrically conductive fibrous members mounted on the rotary shaft member perpendicular to the surface of the rotary shaft member, and configured to contact a leading edge of each of the fibrous members with the surface of the image carrier.

8. The image forming apparatus according to claim 1, wherein a coefficient of surface friction of the image carrier is in a range of from approximately 0.15 to approximately 0.5.

9. An image forming apparatus, comprising:

means for carrying an image and rotating continuously;

means for writing a latent image on the means for carrying;

means for developing the latent image into a visible toner image;

means for charging the means for carrying uniformly while contacting with the means for carrying at a charge nip, the means for charging including a charging brush roller rotating continuously with the means for carrying;

means for applying a charge bias to the means for charging; and means for controlling driving of the means for carrying and the means for charging and reducing a linear velocity ratio of a travel speed of a surface of the charging brush roller to a travel speed of a surface of the means for carrying at the charge nip at a given timing, and the surface of the charging brush roller and the surface of the means for carrying move in a same direction at the charge nip, wherein the means for controlling decreases the linear velocity ratio at the charge nip over time during reduction of the linear velocity ratio, and the means for applying applies a direct current voltage having a polarity opposite to a regular polarity of toner to the means for charging during reduction of the linear velocity ratio.

10. The image forming apparatus according to claim 9, wherein the means for controlling reduces the surface travel speed of the charging brush roller below the surface travel speed of the means for carrying during reduction of the linear velocity ratio.

11. The image forming apparatus according to claim 10, wherein the means for controlling changes the linear velocity ratio at the charge nip to 0.5:1 or less during reduction of the linear velocity ratio.

12. The image forming apparatus according to claim 9, wherein the means for controlling continuously moves the surface of the charging brush roller during reduction of the linear velocity ratio for at least one cycle.

13. The image forming apparatus according to claim 9, wherein a length of a contact portion in a surface travel direction of the means for carrying and the charging brush roller is in a range of from approximately 1 mm to approximately 5 mm.

14. The image forming apparatus according to claim 9, wherein the means for controlling reduces the linear velocity ratio either during starting the means for carrying and the means for charging, at an end of stopping the means for carrying and the means for charging, or both during starting the means for carrying and the means for charging and at the end of stopping the means for carrying and the means for charging.

15. The image forming apparatus according to claim 9, wherein the charging brush roller includes a rotary shaft member and multiple electrically conductive fibrous members mounted on the rotary shaft member perpendicular to the surface of the rotary shaft member, and the charging brush roller is arranged to contact a leading edge of each of the fibrous members with the surface of the means for carrying.

16. The image forming apparatus according to claim 9, wherein a coefficient of surface friction of the means for carrying is in a range of from approximately 0.15 to approximately 0.5.

17. A method of image forming, comprising:

rotating an image carrier to move a surface thereof continuously;

writing a latent image on the surface of the image carrier, the surface of the image carrier being charged;

developing the latent image formed on the surface of the image carrier into a visible toner image;

rotating a charging brush roller to move with the image carrier at a portion contacting the charging brush roller with the image carrier;

uniformly charging the surface of the image carrier while contacting a surface thereof with the surface of the image carrier at a charge nip;

applying a charge bias to the charging brush roller;

reducing a linear velocity ratio of a travel speed of the surface of the charging brush roller to a travel speed of the surface of the image carrier at the charge nip at a given timing;

decreasing over time the linear velocity ratio at the charge nip during the reducing the linear velocity ratio; and applying a direct current voltage having a polarity opposite to a regular polarity of toner to the charging member during the reducing the linear velocity ratio.

18. The image forming method according to claim 17, further comprising:

reducing the surface travel speed of the charging brush roller below the surface travel speed of the image carrier during the reducing the linear velocity ratio.

19. The image forming method according to claim 18, further comprising:

changing the linear velocity ratio at the charge nip to 0.5:1 or less during the reducing the linear velocity ratio.

20. The image forming method according to claim 17, further comprising:

continuously moving the surface of the charging brush roller during the reducing the linear velocity ratio for at least one cycle.

* * * * *